US011419382B2

(12) United States Patent
Teetzel et al.

(10) Patent No.: US 11,419,382 B2
(45) Date of Patent: Aug. 23, 2022

(54) MODULAR HELMET SYSTEM

(71) Applicant: Wilcox Industries Corp., Newington, NH (US)

(72) Inventors: James W. Teetzel, Portsmouth, NH (US); Edward R. Hall, Madbury, NH (US); Ned A. Dalzell, Portsmouth, NH (US)

(73) Assignee: Wilcox Industries Corp., Newington, NH (US)

( * ) Notice: Subject to any disclaimer, the term of this patent is extended or adjusted under 35 U.S.C. 154(b) by 9 days.

(21) Appl. No.: 17/229,202

(22) Filed: Apr. 13, 2021

(65) Prior Publication Data

US 2021/0315314 A1 Oct. 14, 2021

Related U.S. Application Data

(60) Provisional application No. 63/009,783, filed on Apr. 14, 2020.

(51) Int. Cl.
*A42B 3/30* (2006.01)
*A42B 3/04* (2006.01)

(52) U.S. Cl.
CPC ..... *A42B 3/30* (2013.01); *A42B 3/044* (2013.01)

(58) Field of Classification Search
CPC ..... A42B 3/044; A42B 3/30
See application file for complete search history.

(56) References Cited

U.S. PATENT DOCUMENTS

| | | | |
|---|---|---|---|
| 5,467,479 | A | 11/1995 | Mattes |
| 2013/0239303 | A1 | 9/2013 | Cotterman et al. |
| 2019/0386412 | A1 | 12/2019 | Goupil et al. |
| 2020/0225488 | A1 | 7/2020 | Goupil et al. |

FOREIGN PATENT DOCUMENTS

| | | | |
|---|---|---|---|
| EP | 1832189 | A1 | 9/2007 |
| FR | 3066364 | A3 | 11/2018 |

OTHER PUBLICATIONS

European Examination Report dated Sep. 10, 2021 received in European Application No. EP21168390.9.
English machine translation of French Patent Application Publication No. 3066364A3.
English machine translation of European Patent Application Publication No. 1832189A1.

*Primary Examiner* — Thomas M Sember
(74) *Attorney, Agent, or Firm* — McLane Middleton, Professional Association

(57) ABSTRACT

A helmet mounting system for attaching an accessory device to a helmet includes one or more cables with a hook for removably engaging the brim of the helmet. Each cable has an end attached to a spool which is rotatable in a first direction for winding of the cable(s) around the spool and a second direction for unwinding the cable. A tensioning mechanism is coupled to the spool. In certain embodiments, one or more accessory devices are electrically coupled to a power and data management module for routing power, data and control signals to the one or more accessory devices. Accessory devices are interchangeable, providing a modular system that can be customized to meet mission requirements and accessory devices are removable and replaceable as mission requirements change.

20 Claims, 41 Drawing Sheets

MODULAR HELMET SYSTEM

CROSS REFERENCE TO RELATED APPLICATION

This application claims the priority benefit of U.S. provisional application Ser. No. 63/009,783 filed Apr. 14, 2020. The aforementioned application is incorporated herein by reference in its entirety.

BACKGROUND

The present invention relates to protective helmets and, in particular, to a helmet accessory mounting system and method for interchangeably attaching one or more helmet accessory devices.

Commonly, military field helmets, combat helmets, or the like, are configured with mounts, brackets, and so forth to carry one or more accessories or attachments, such as a flashlights, viewing optics and devices, such as a monocular, binoculars, monocular or binocular night vision (NVG) devices (including passive night vision devices and enhanced night vision (eNVG) devices), thermal imaging devices, cameras, friend or foe identification (IFF) systems, communications devices, power supplies, and others.

Often such fastening systems utilize fasteners that penetrate one or more layers of the shell of the helmet. This is particularly disadvantageous for helmets that are designed for ballistic protection since holes formed the helmet can compromise the ballistic integrity of the helmet.

In addition, many of the existing fastening systems are dedicated for attaching a particular helmet accessory device or type of accessory device. As the number of types of accessories available increases, it would be desirable to provide a helmet mounting system that allows the user to readily remove and attach various accessories to the helmet to accommodate different situations or mission requirements, wherein the various accessories can be attached with a system that employs common mounting hardware.

The present disclosure contemplates a new and improved helmet accessory mounting system and method which overcomes the above-referenced problems and others.

SUMMARY

A helmet mounting system comprises a helmet including a shell configured to fit over a user's head. A fastener system is provided for removably attaching one or more accessory devices to the helmet. The fastener system includes one or more cables, each of said one or more cables having a proximal portion attached to a tensioning mechanism and a distal portion. The fastener system further includes a hook attached to each distal end of said one or more cables. The hook may be directly attached to a cable. In certain embodiments, the hook is removably attached to the cable. Alternatively, the hook may be attached to a housing or enclosure of an accessory device, wherein the cable attaches to the housing or enclosure. In certain embodiments, the hooks are integrally formed with the housing or enclosure. In certain embodiments, the hooks are separately formed and attached to the respective housing or enclosure with one or more fasteners. In certain embodiments, the hooks are separately formed and adjustably attached to the respective housing or enclosure with one or more fasteners. The hook is configured to removably engage a brim portion of the shell. The tensioning mechanism includes a spool which is rotatable in a first direction to cause a winding of the cable around the spool and a second direction opposite the first direction to cause an unwinding of the cable around the spool. Rotation of the spool in the first direction is configured to increase tension in the cable for securing the accessory device to the helmet and rotation of the spool in the second direction is configured to decrease tension in the cable for releasing the accessory device from the helmet. In certain embodiments, a ratchet mechanism is provided to prevent rotation of the spool in the second direction unless the ratchet pawl is manually disengaged.

One advantage of the present development is that it allows a user to customize the helmet based on mission requirements.

Another advantage of the present development is found in its modularity in that it provides the ability to swap out individual accessory components.

Another advantage of the present development resides in its ability to provide power and data connections to accessory components.

Still further advantages and benefits of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1C:
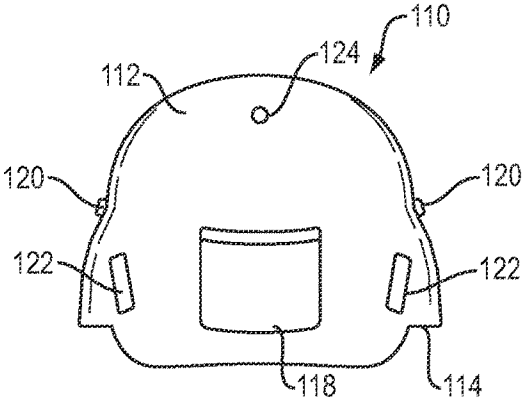
FIGS. 1A-1D are front, left side, rear, and top views, respectively, of a power and data node configuration for an exemplary helmet system embodiment in accordance with the present development.
Figure 1B:
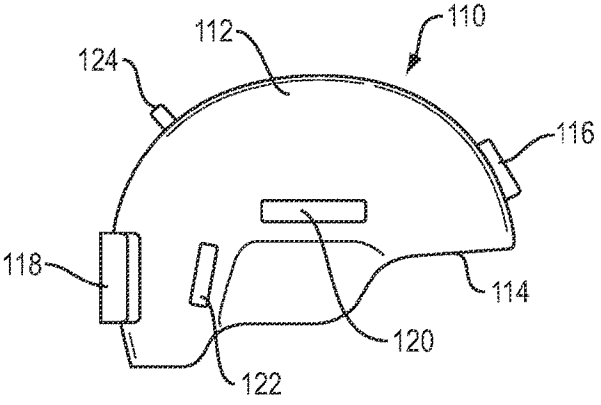
Figure 1A:
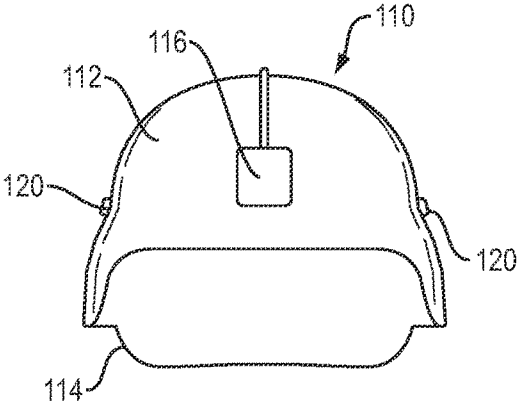
Figure 1D:
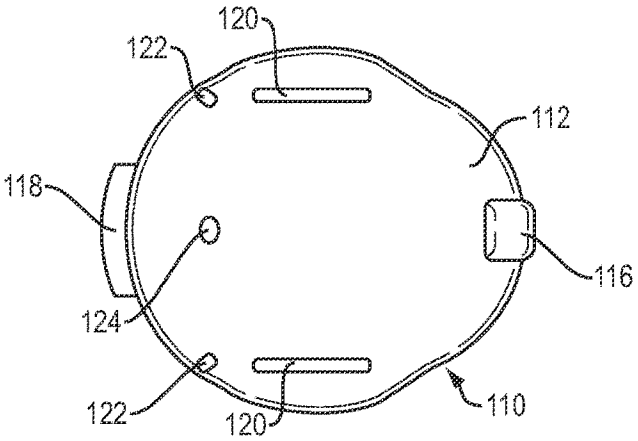
Figure 2C:
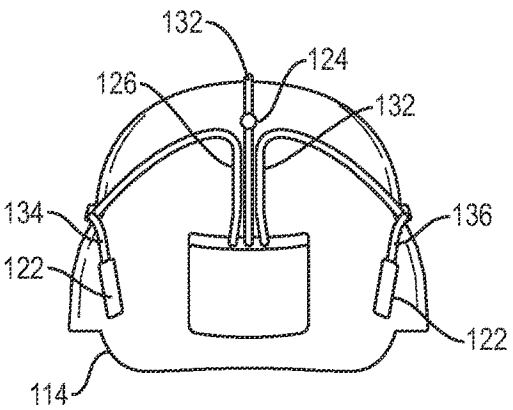
FIGS. 2A-2D are front, left side, rear, and top views, respectively, of a first exemplary embodiment of a power and data cable routing configuration for a helmet system utilizing the power and data node configuration appearing in FIGS. 1A-1D.
Figure 2B:
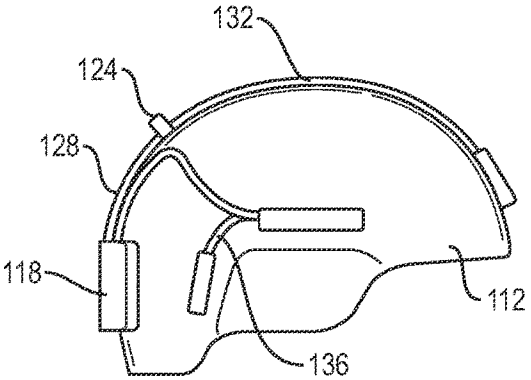
Figure 2D:
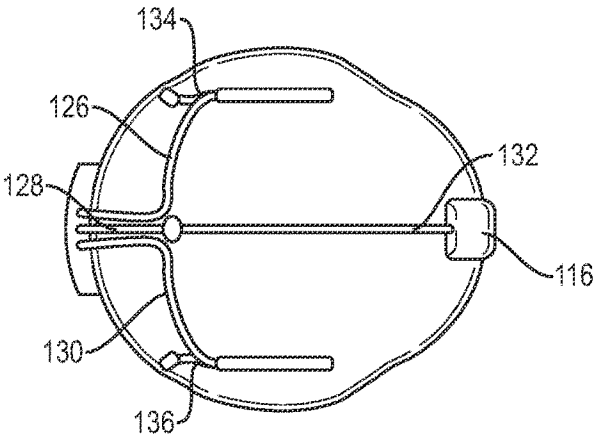
Figure 2A:
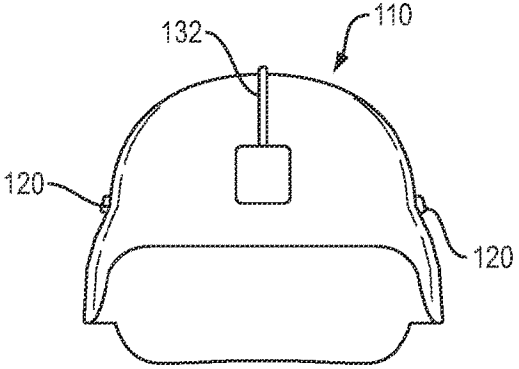
Figure 3A:
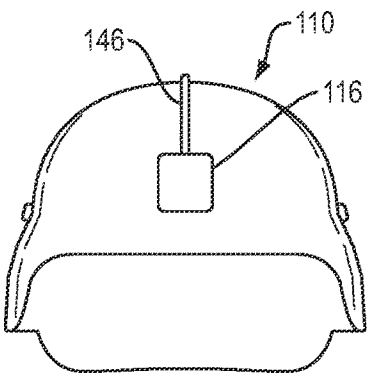
FIGS. 3A-3D are front, left side, rear, and top views, respectively, of a second exemplary embodiment of a power and data cable routing configuration for a helmet system utilizing the power and data node configuration appearing in FIGS. 1A-1D.
Figure 3B:
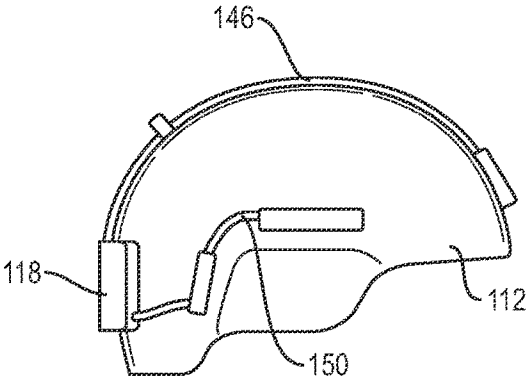
Figure 3C:
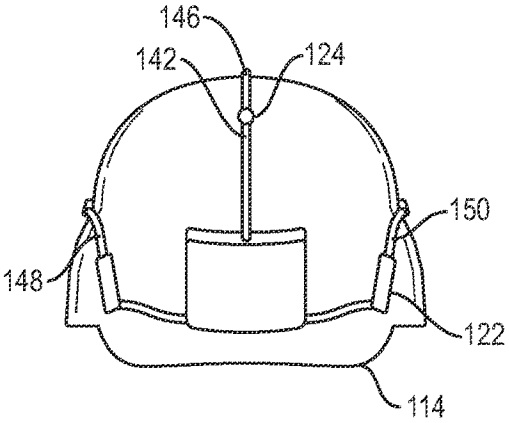
Figure 3D:
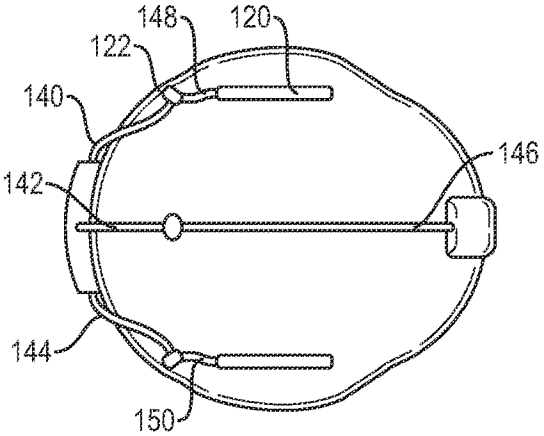
Figure 4C:
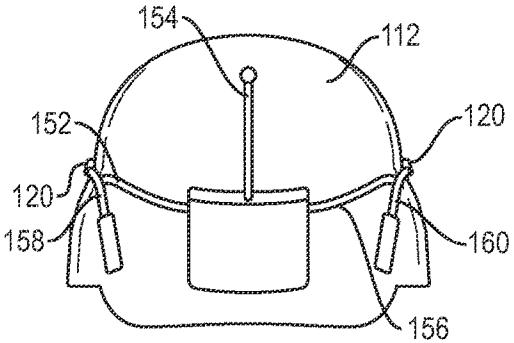
FIGS. 4A-4D are front, left side, rear, and top views, respectively, of a third exemplary embodiment of a power and data cable routing configuration for a helmet system utilizing the power and data node configuration appearing in FIGS. 1A-1D.
Figure 4B:
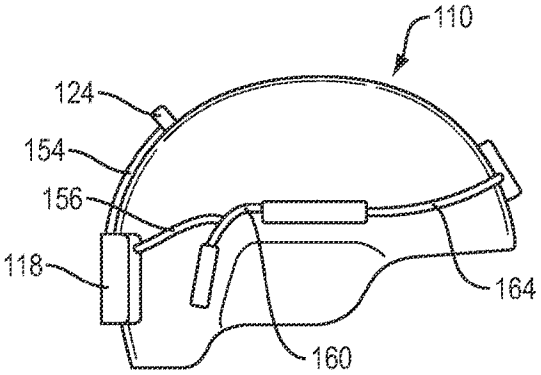
Figure 4D:
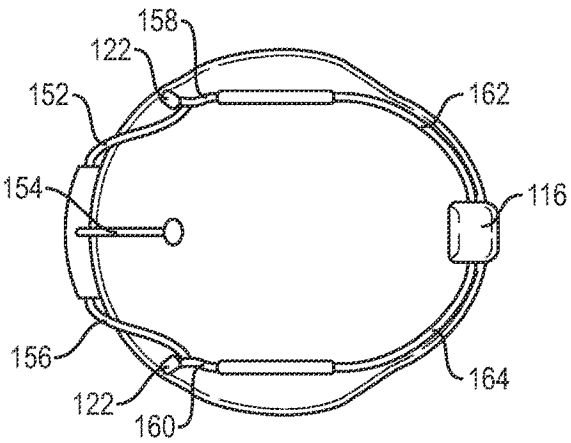
Figure 4A:
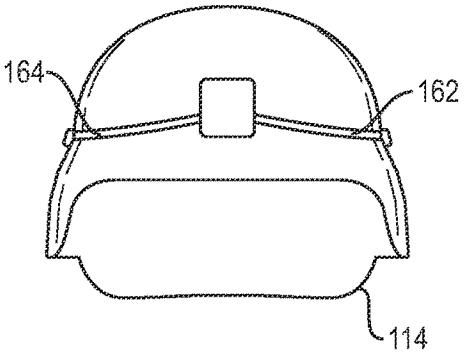
Figure 5C:
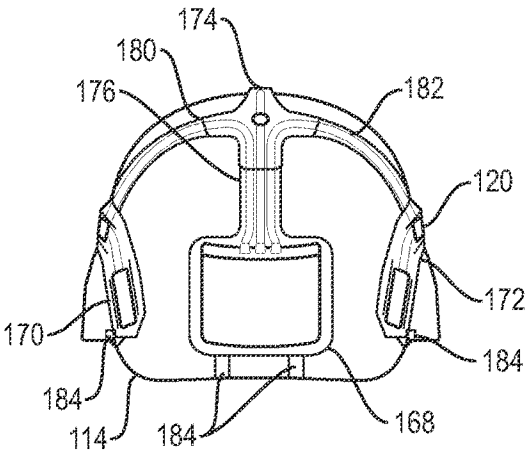
FIGS. 5A-5D are front, left side, rear, and top views, respectively, of a helmet system utilizing the high branching power and data routing configuration appearing in FIGS. 2A-2D, and further illustrating the enclosures or housings for the mounting mechanisms, electronics, and the data and power cables.
Figure 5B:
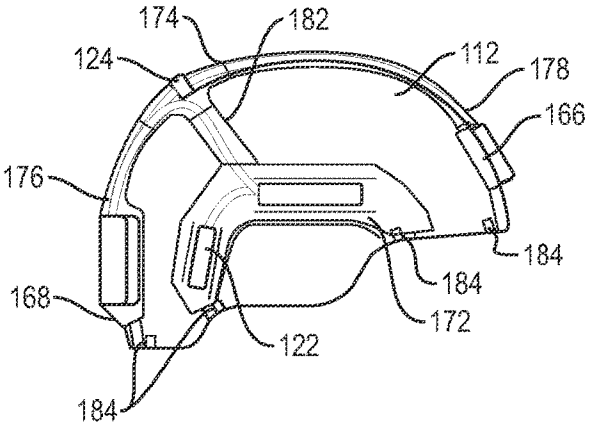
Figure 5A:
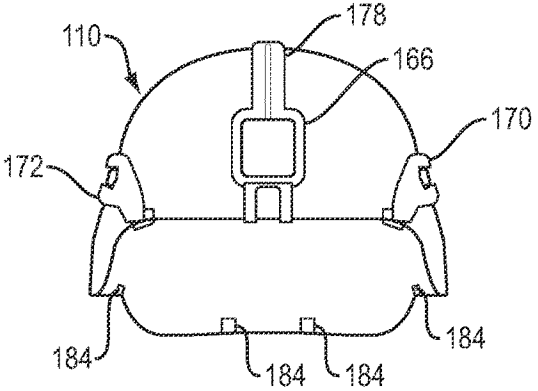
Figure 5D:
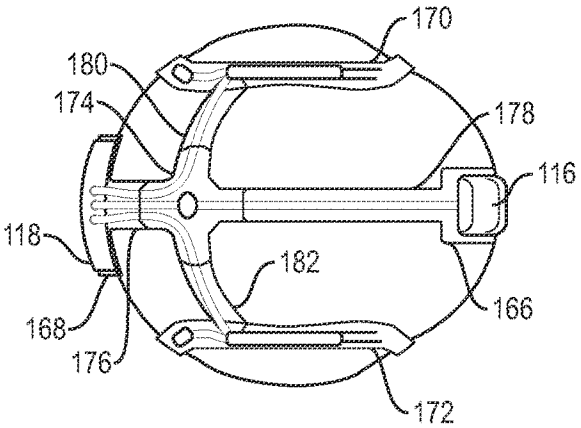
Figure 6C:
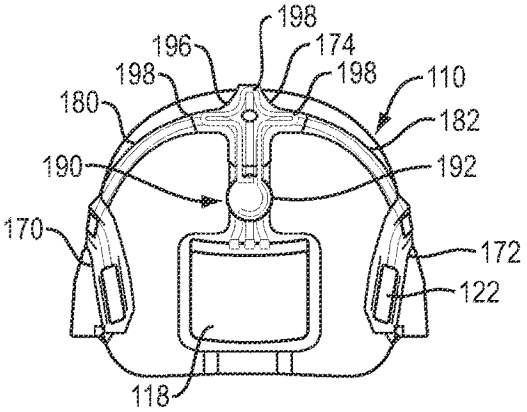
FIGS. 6A-6D are front, left side, rear, and top views, respectively, of an exemplary tensioning system, illustrated in connection with the high branching accessory device and housing configuration appearing in FIGS. 5A-5D.
Figure 6B:
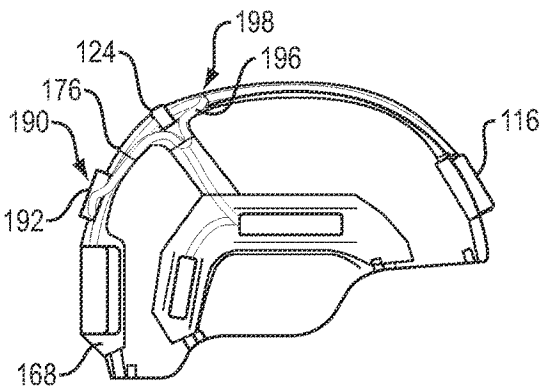
Figure 6D:
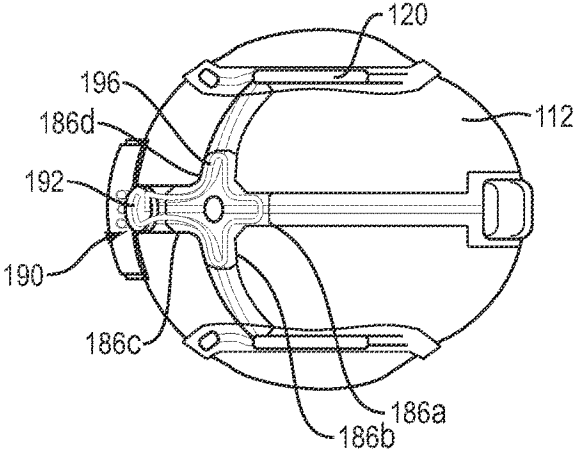
Figure 6A:
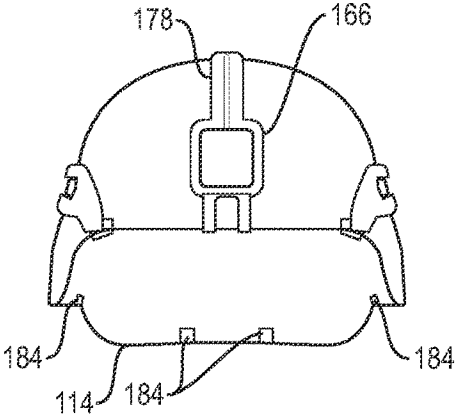

Referring now to the drawings, wherein like reference numerals are used to depict like or analogous components throughout the several views, a helmet mounting system includes a helmet 110. The helmet 110 may be a military field or combat helmet, tactical helmet for military or law enforcement personnel, or other type protective headgear where it is desired to mount one or more accessory devices on the helmet.

The helmet 110 includes a shell portion 112 configured to fit over a user's head and having a peripheral edge or brim 114. The shell 112 may be formed of any material used for protective headgear, including metal, polymer, and composite materials. In certain embodiments, the shell is formed of multiple plies of a fiber reinforced polymer composite material. In certain embodiments, the fibers are aramid (e.g., KEVLAR®) fibers. In certain embodiments, the shell is of a type having anti-ballistic properties. In certain embodiments, the shell 112 is formed of a polyolefin such as ultra-high molecular weight polyethylene (UHMWPE) such as DYNEEMA™ or SPECTRA™. In certain embodiments, the shell is formed of a polyolefin material in combination with fiber reinforcement layers, such as aramid, carbon, glass, or combinations thereof. The shell 112 may include an outer layer to provide the shell with a desired finished appearance. Likewise, the brim 114 may include an edge trim material covering the raw or unfinished peripheral edge of the shell.

The drawings depict particular arrangements of accessory components. It will be recognized that other configurations and combinations of components are contemplated.

I. Power/Data Nodes

Referring now to FIGS. 1A-1D, there appears a power and data node configuration for an exemplary helmet system embodiment in accordance with the present development. A shroud 116 is disposed at a front and central portion of the shell 112. In certain embodiments, the shroud 116 is of the type configured for attaching a mounting apparatus of the type used to position a visual augmentation system before the eye(s) of the user. Exemplary visual augmentation systems include optical viewing devices, night vision or enhanced night vision devices, head up or near eye displays, cameras, thermal imaging devices, and others.

A power and data management module 118 is disposed at a rear and central portion of the shell 112. The module 118 is configured to be electrically coupled to one or more accessory components attached to the shell 112. The module 118 includes one or more batteries for supplying electrical power to one or more accessory components attached to the shell 112. The module 118 also includes circuit components for the transfer of data signals between accessory components attached to the shell 112. As used herein, the term data signal includes digital or analog signals representative of data to be transferred to or from an attached accessory components as well as digital or analog signals for controlling the operation of an attached accessory component. In certain embodiments, the accessories, cables, connectors, flex circuits, as described in greater detail below are hardened or ruggedized. Alternately or additionally, the housings and enclosures as described in greater detail below, are formed of hardened or ruggedized materials.

In the illustrated embodiment of FIGS. 1A-1D, a first set of accessory rail interface components 120 are disposed on opposite sides of the shell 112. A second of accessory rail components 122 are likewise disposed on opposite sides of the helmet 112. In certain embodiments, the accessory rail components 120, 122 are configured to for mechanical attachment of an accessory device having a complementary accessory rail clamp. In certain embodiments, the accessory rail components 120, 122 are configured to both mechanical attachment of the accessory device as well as a power and/or data connection to the accessory device, e.g., a so-called smart rail interface. In certain embodiments, the accessory rail components comprise a segment of a standard military rail interface such a Picatinny rail interface (e.g., MIL-STD-1913 rail or STANAG 2324 rail) having a beveled T-shaped cross-sectional shape having a series of alternating transverse groves and flats as would be understood by persons skilled in the art.

In the illustrated embodiment of FIGS. 1A-1D, an identification friend or foe (IFF) marking strobe or beacon 124 is mounted to the shell 112. Preferably, the IFF unit 124 is disposed along a centerline of the shell 112 at a position that is at or near the crown of the shell 112 to provide 360-degree coverage.

II. Power/Data Routing

A. Branching High

Referring now to FIGS. 2A-2D, there is shown a first embodiment of a power and data cable routing configuration for a helmet system utilizing the power and data node configuration appearing in FIGS. 1A-1D. Enclosures for routing the cabling and protecting the cabling and mounting mechanisms are omitted for ease of exposition. The embodiment of FIGS. 2A-2D utilizes a high branching concept, wherein the cabling travels up along the helmet centerline and splits from the centerline to the opposing left and right sides of the helmet at a relatively high latitudinal position of the shell 112. Three power/data cables 126, 128, and 130 each have a first end that is electrically coupled to circuitry within the module 118. Each cable has a plurality of conductors for electrical communication with corresponding power and data contacts or connectors of the attached accessory devices.

The cable 128 runs from the module 118 along the centerline of the shell 112 to the IFF module 124. A cable 132 in electrical communication with the cable 128 continues along the centerline of the shell 112 to the shroud module 116 disposed on the front of the helmet. The cables 126 and 130 each run from the module 118 adjacent and parallel to the cable 128 on the left and right sides, respectively, of the cable 128. When the cable 126 reaches a latitude that is at or near the latitude of the IFF module 124, it is run to the left accessory rail 120. Likewise, when the cable 130 reaches a latitude that is at or near the latitude of the IFF module 124, it is run to the right accessory rail 120. A cable 134 in electrical communication with the cable 128 continues to the left accessory rail 122. A cable 138 in electrical communication with the cable 132 continues to the right accessory rail 122.

B. Branching Low

Referring now to FIGS. 3A-3D, there is shown a second embodiment of a power and data cable routing configuration for a helmet system utilizing the power and data node configuration appearing in FIGS. 1A-1D. Enclosures for routing the cabling and protecting the cabling and mounting mechanisms are omitted for ease of exposition. The embodiment of FIGS. 3A-3D utilizes a low branching concept, wherein the cabling splits from the helmet centerline to the opposing left and right sides of the helmet at a relatively low latitudinal position of the shell 112. Three power/data cables 140, 142, and 144 each have a first end that is electrically coupled to circuitry within the module 118. Each cable has a plurality of conductors for electrically coupling with corresponding power and data contacts or connectors of the attached accessory devices.

The cable 142 runs from the module 118 along the centerline of the shell 112 to the IFF module 124. A cable 146 in electrical communication with the cable 142 continues along the centerline of the shell 112 to the shroud module 116. The cables 140 and 144 each run from the module 118 to the respective left and right accessory rails 122. A cable 148 in electrical communication with the cable 140 continues to the left accessory rail 120. A cable 150 in electrical communication with the cable 144 continues to the right accessory rail 120.

C. Looping

Referring now to FIGS. 4A-4D, there is shown a third embodiment of a power and data cable routing configuration for a helmet system utilizing the power and data node configuration appearing in FIGS. 1A-1D. Enclosures for routing the cabling and protecting the cabling and mounting mechanisms are omitted for ease of exposition. The embodiment of FIGS. 4A-4D utilizes a looping concept, wherein the power and data cables generally encircle the shell 112. Three power/data cables 152, 154, and 156 each have a first end that is electrically coupled to circuitry within the module 118. Each cable has a plurality of conductors for electrically coupling with corresponding power and data contacts or connectors of the attached accessory devices.

The cable 154 runs from the module 118 along the centerline of the shell 112 to the IFF module 124. A cable 158 runs from the left accessory rail 122 to the left accessory rail 120. A cable 160 runs from the right accessory rail 122 to the right accessory rail 120. The second end of the cable 152 runs to the cable 158. The second end of the cable 156 runs to the cable 160. Cables 162, 164 run from the respective left and right accessory rails 120 to the front shroud 116.

III. Enclosures

Referring now to FIGS. 5A-5D, there is shown a helmet system utilizing the high branching power and data routing configuration which as discussed above by way of reference to FIGS. 2A-2D, and further illustrating the enclosures or housings for the mounting mechanisms, electronics, and the data and power cables. In the illustrated embodiment of FIGS. 5A-5D, the various device housings utilize hooks engaging the brim 114 of the shell 112. The tensioning cables and cinch mechanism are omitted in FIGS. 5A-5D for ease of exposition.

In the illustrated embodiment, there appears a first housing member 166 receiving the shroud 116 and second housing 168 receiving the power and data management module 118. A third housing 170 receives the left side accessory rail interface components 120 and 122 and the cable 134 running therebetween and a fourth housing 172 receives the right side accessory rail components 120, 122 and the cable 136 running therebetween A fifth housing 174 receives the IFF beacon 124. A rear cable enclosure 176 is coupled to the housing 168 and receives the cables 126, 128, 130 running from the power and data management module 118. A front cable housing 178 is coupled to the front housing 166 and receives the cable 132 running from the IFF module 124 to the shroud 116. A left side cable enclosure 180 is coupled to the left housing 170 and receives the cable 126 running to the left accessory interface 120. A right side cable enclosure 182 is coupled to the right housing 172 and receives the cable 130 running to the right accessory interface 120.

The enclosures or housings 166, 168, 170, 172, 174, 176, 178, 180, and 182 may be formed of a polymer material or a composite material such as a fiber reinforced composite material comprising fiber reinforcements in a polymer matrix. Enclosures 166 and 178 may be integrally formed or separately formed and attached. Enclosures 168 and 176 may be integrally formed or separately formed and attached. Enclosures 170 and 180 may be integrally formed or separately formed and attached. Enclosures 172 and 182 may be integrally formed or separately formed and attached.

Figure 8:
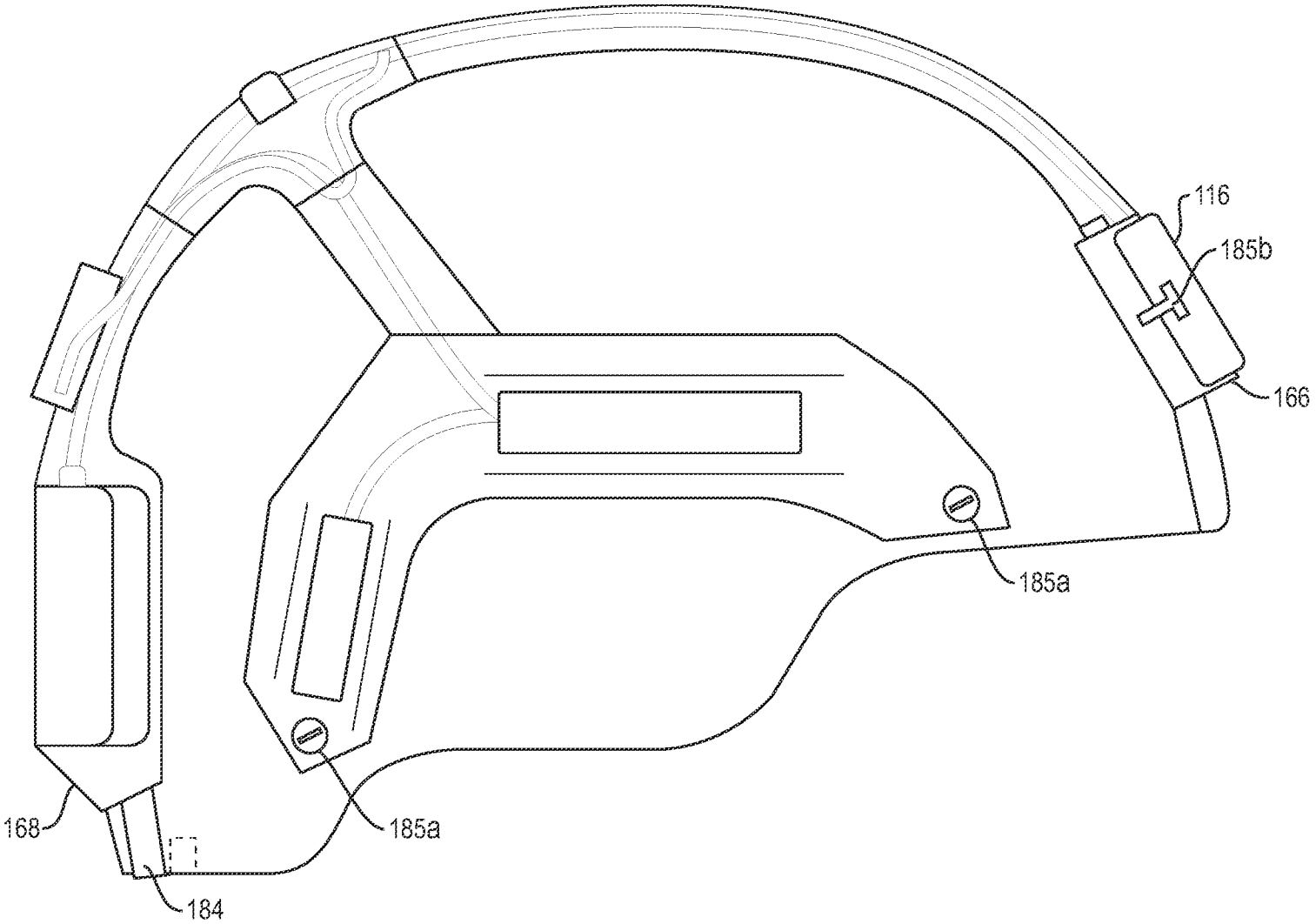
FIG. 8 illustrates an alternative embodiment employing a combination of helmet-specific mounting hardware and a self-tensioning system.

The enclosures provide routing and physical protection for the electronics as well as a helmet mounting mechanism. The modular approach of the present development allows combinations of common parts to accommodate most helmet styles and sizes. In certain embodiments, the housing utilizes helmet-specific mounting hardware, e.g., threaded fasteners for securing the accessory devices to the helmet. In other embodiments, a self-tensioning system is provided for a boltless solution which eliminates the need for piercing the shell 112. In still further embodiments, a combination of helmet-specific mounting hardware and a self-tensioning system is utilized, for example, as shown in FIG. 8.

In certain embodiments, each of the housing members 166, 168, 170, and 172 includes one or more, preferably two or more, and most preferably two hooks 184 which are sized to wrap around and engage the brim 114 of the helmet shell 112 and a tensioning mechanism is provided to selectively apply tension to secure the hooks to the brim 114 and selectively release tension for removal of the accessory components. In certain embodiments, the hooks may be separately formed and attached to the respective housings, and may be, for example, metal hooks. In certain embodiments, such metal hooks may be adjustable to accommodate different sized helmet, different brim thicknesses, etc. Alternatively, in certain embodiments, the hooks may be integrally formed with the housing and may be, for example, formed of a plastic or composite material.

It will be recognized that the housing/enclosures members appearing in FIGS. 5A-5D may readily adapted for other accessory configurations, such as the low branching and loop configurations appearing in FIGS. 3A-3D and FIGS. 4A-4D, respectively.

IV. Tensioning Mechanisms

Figure 7:
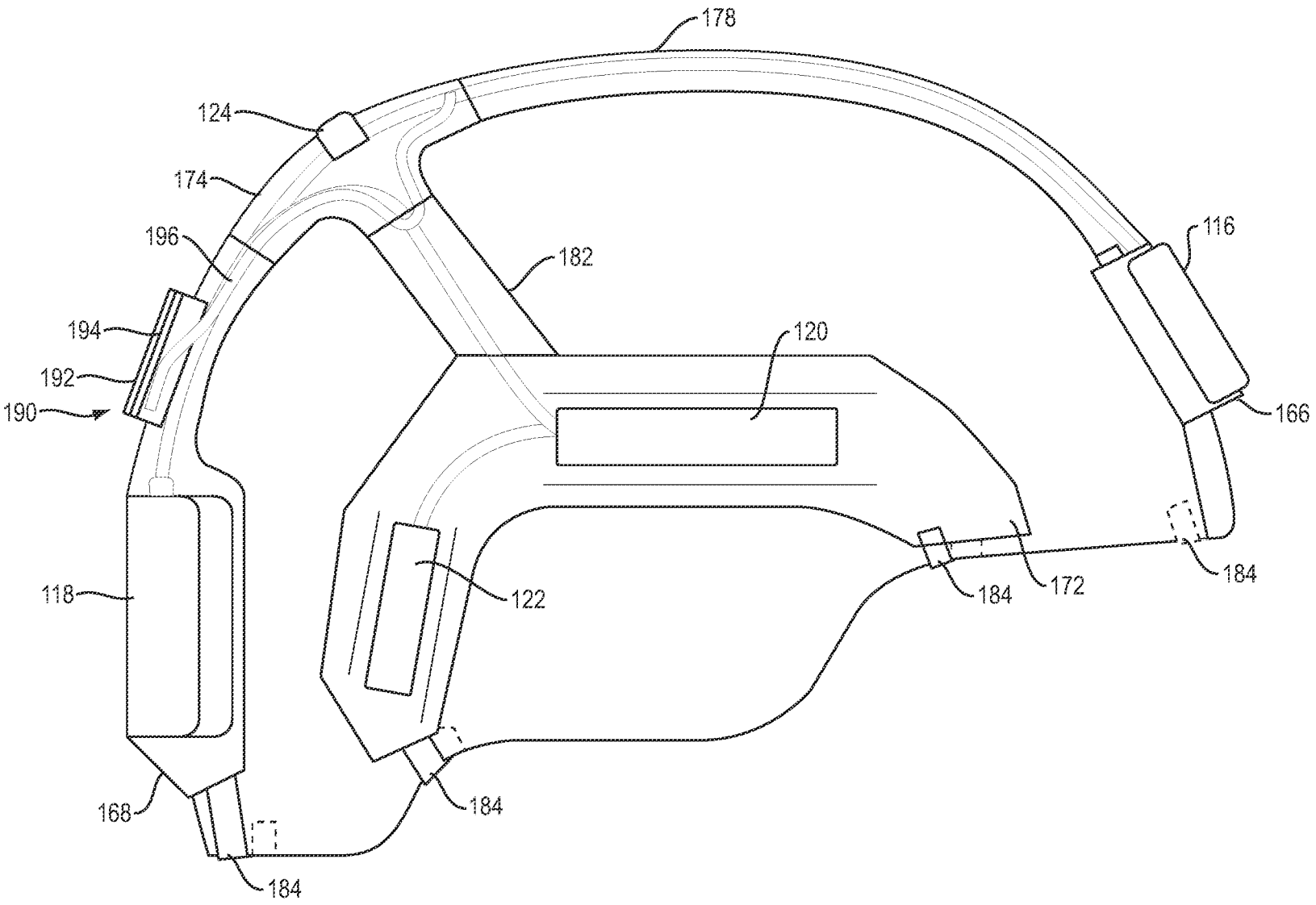
FIG. 7 is an enlarged view of the helmet system appearing in FIG. 6B.

Referring now to FIGS. 6A-6D, there appears an exemplary tensioning system, illustrated in connection with the high branching accessory device and housing configuration appearing in FIGS. 5A-5D. The housing 174 includes four radially extending arms 186*a*, 186*b*, 186*c*, and 186*d*, each of which defines a channel or track. The arm 186*a* slidably engages the housing section 178. The arm 186*b* slidably engages the housing section 182. The arm 186*c* slidably engages the housing section 176. The arm 186*d* slidably engages the housing section 180. In the illustrated embodiment, a tensioning mechanism 190 is secured to the housing section 176. The tensioning mechanism 190 includes a manually rotatable knob or dial mechanism 192 coupled to a spool 194. A cinch cord 196 has first and second ends, which are secured to the spool. The cord 196 passes through a series of cable guides 198, such as openings, loops, hooks, or the like in the respective housing sections 178, 182, 176, and 180. Rotation of the dial 192 in the tightening direction causes a portion of the cord 196 to be taken up on the spool, thus shortening the effective length of the cord and causing the respective housing sections 178, 182, 176, and 180 to be drawn toward each other. Tension is transferred from the cable to the hooks 184 via the respective housings. The cord 196 and/or hooks 198 are preferably formed of a low friction material to ensure that tension is distributed equally to the respective housing sections 178, 182, 176, and 180. An enlarged view of FIG. 6B appears in FIG. 7.

Figure 11C:
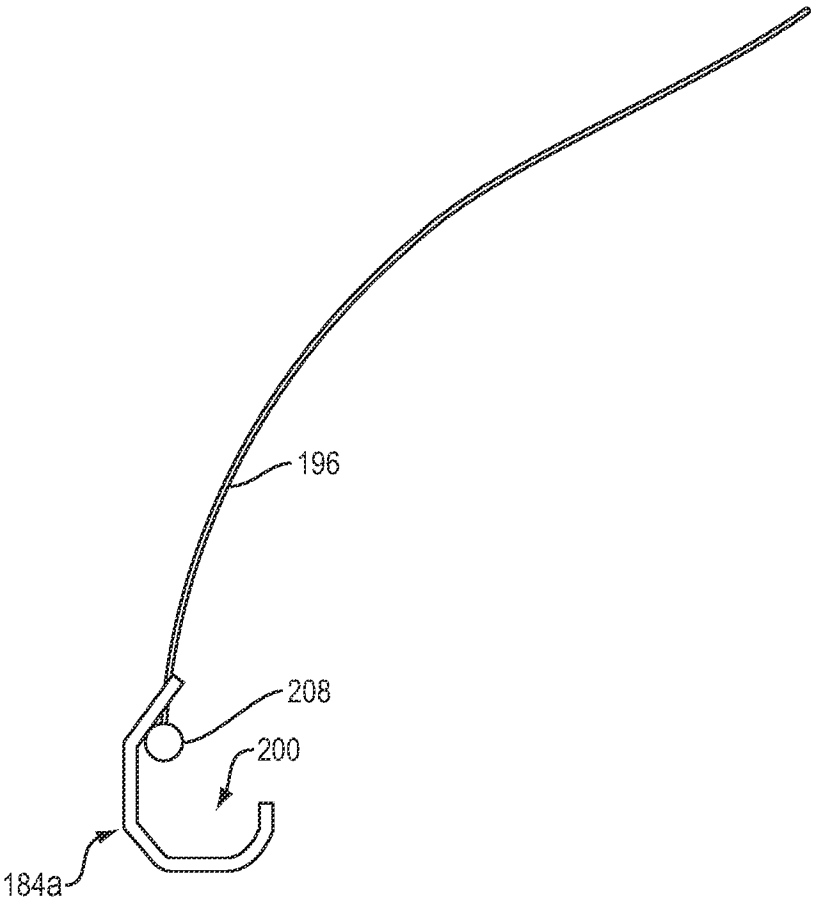
FIGS. 11B and 11C are front and side views, respectively, showing the tension cable attached to a hook.
Figure 11B:
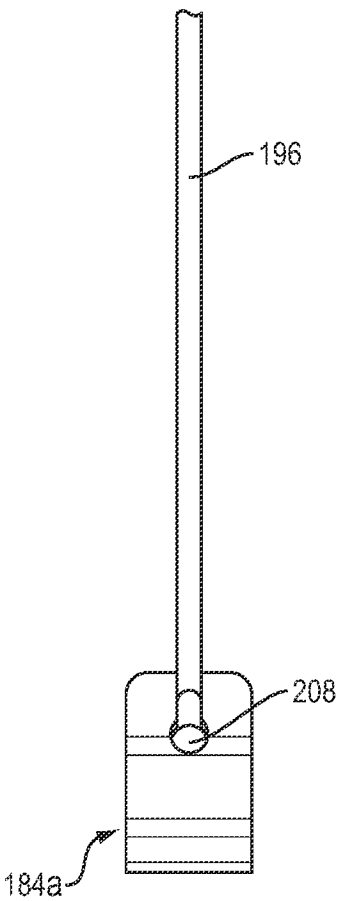
Figure 11A:
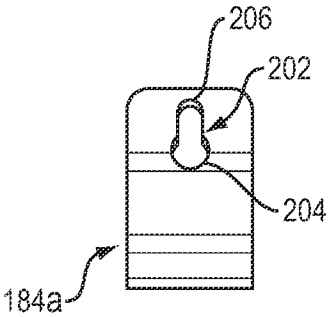
FIG. 11A shows an exemplary hook configured to attach directly to a tension cable.
Figure 11E:
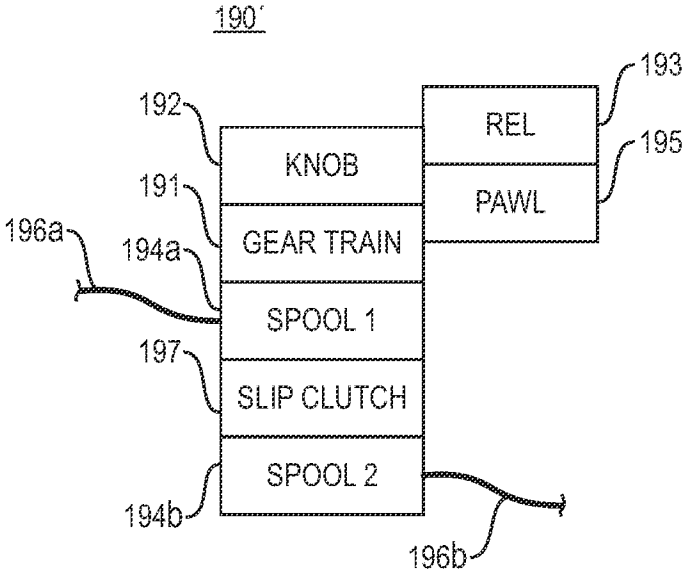
FIG. 11E illustrates a second exemplary embodiment tension mechanism.
Figure 11D:
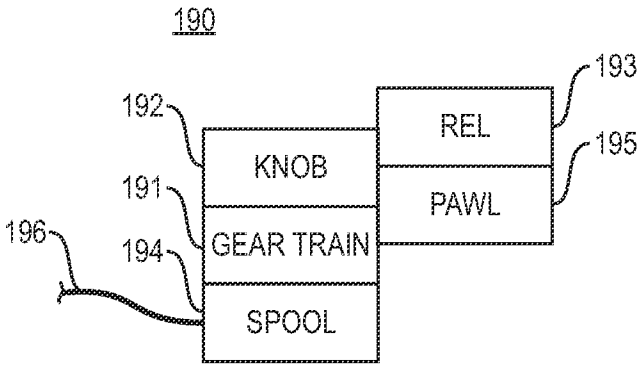
FIG. 11D illustrate a first exemplary embodiment tension mechanism.

Referring now to FIG. 11D, there appears an exemplary tension mechanism 190 which includes a ratchet mechanism. An exemplary ratchet mechanism includes a pawl 195 engaging a gear to constrain rotation in tightening direction only and a release mechanism 193, such as a button or lever, for disengaging the pawl 195 from the gear (e.g., against the urging of an associated spring or other resilient member biasing the pawl into engagement with the gear) to allow loosening of the cord 196 for removal and reconfiguration of the helmet system. Other dial modes that provide for selective tensioning and release of the cinch cable 196 are also contemplated. In certain embodiments, the dial 192 is movable along the axis of rotation toward and away from the helmet between a first position and a second position to allow the dial rotation to selectively provide ratcheting/tightening of the cinch cord 196 and loosening/despooling of the cinch cord 196. In certain embodiments, movement of the knob/dial 192 to a down or depressed position allows the dial 192 to be rotated in the ratcheting, tightening direction, and movement of the knob/dial 192 to an up or lifted position disengages the ratchet mechanism so that the cord can be loosened/despooled. Alternatively, in certain embodiments, movement of the knob/dial 192 to a down or depressed position locks the dial 192 to prevent rotation of the spool in either direction and movement of the knob/dial 192 to an up or lifted position allows ratcheting tightening and loosening.

In certain embodiments, the tensioning mechanism includes an optional gear train 191 between the knob 192 and the spool 194 for increasing the mechanical advantage of the knob 192 and providing a finer resolution of the tension adjustment.

Referring now to FIG. 11E, there appears another exemplary embodiment tensioning member 190' which is similar to the embodiment appearing in FIG. 11D, except wherein there are two spools 194*a* and 194*b* having two separate tension cords 196*a* and 196*b*, respectively. A slip clutch 197 disposed between the spools 194*a*, 194*b* is configured to slip when a predetermined tension or torque is reached to allow each spools to be tightened independently of the other. Other numbers of spools and slip clutches are also contemplated. In still further embodiments, a system employing multiple tension cords is contemplated wherein each tension cord has a dedicated tension mechanism/knob.

Figure 11F:
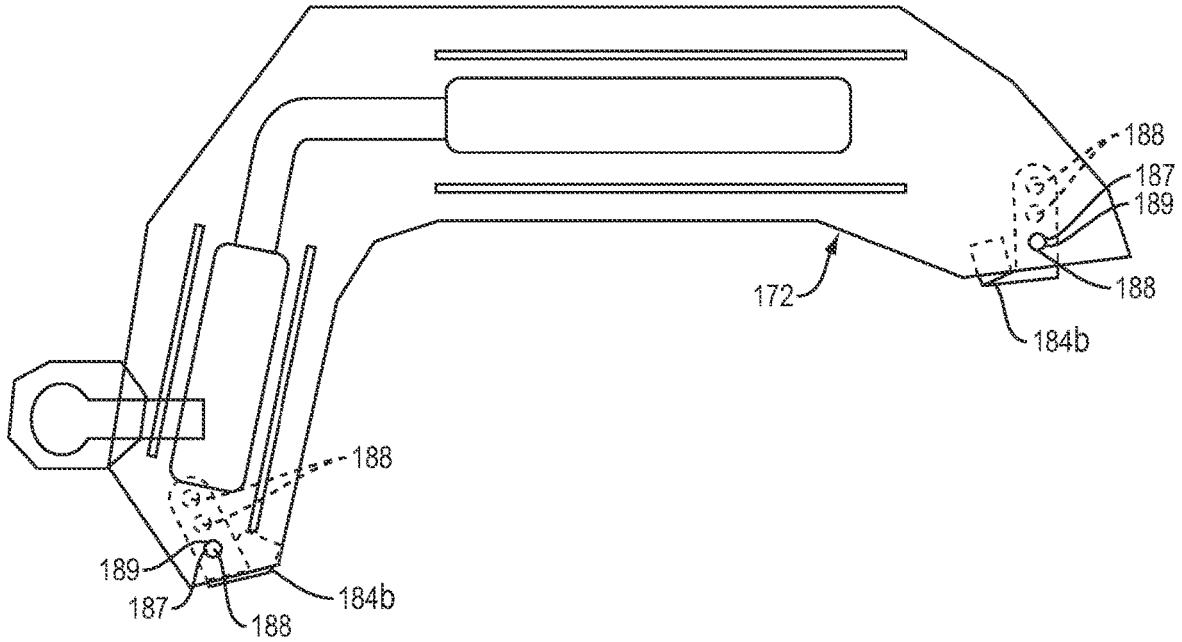
FIGS. 11F and 11G illustrate an exemplary housing member having hooks adjustably attached thereto.
Figure 11G:
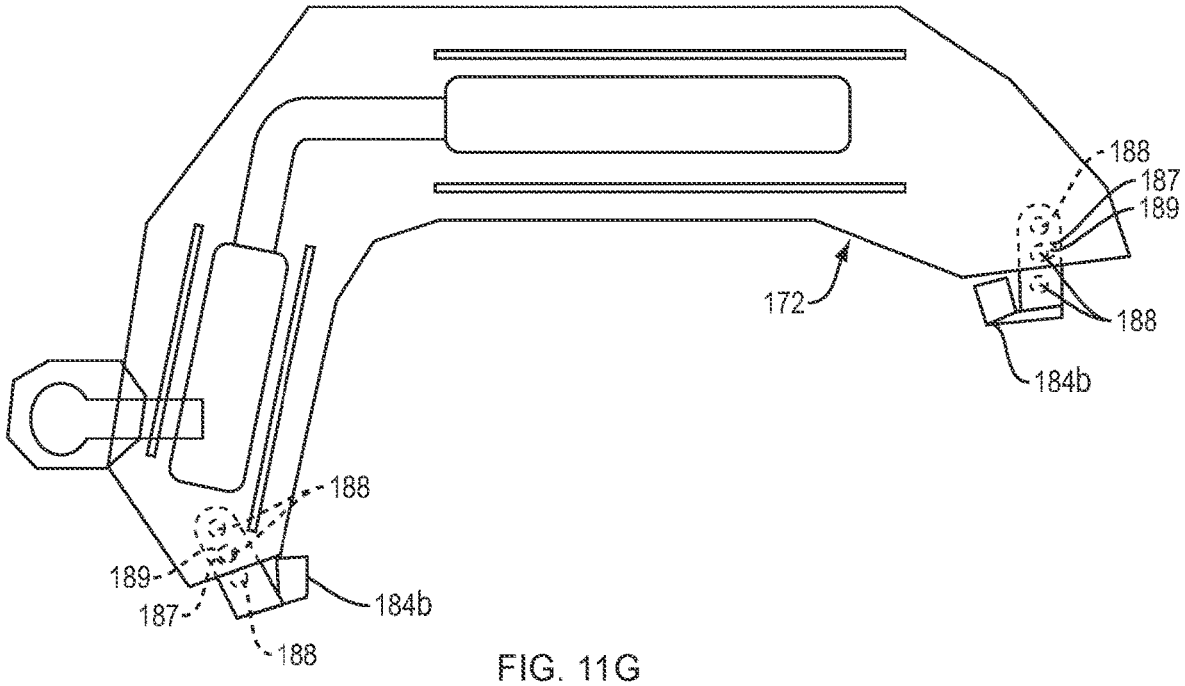

Referring now to FIGS. 11F and 11G, there appears an exemplary housing member 172 having hooks 184*b* adjustably attached thereto. The adjustable hooks 184*b* have a series of clearance openings 188, wherein the hook is secured by a fastener 187 engaging a selected one of the clearance openings 188 and a complementary and aligned opening 189 in the housing member 172. In this manner, the clearance opening 188 can be selected to adjust the distance between the housing member and the base of the channel portion 200 of the hook.

Referring now to FIG. 8, there appears an alternative embodiment which is as described above by way of reference to the embodiment of FIGS. 6A-6D, except that some of the hooks 184 have been replaced with conventional threaded fasteners 185*a*, 185*b*.

V. Two Leg System

Figure 9:
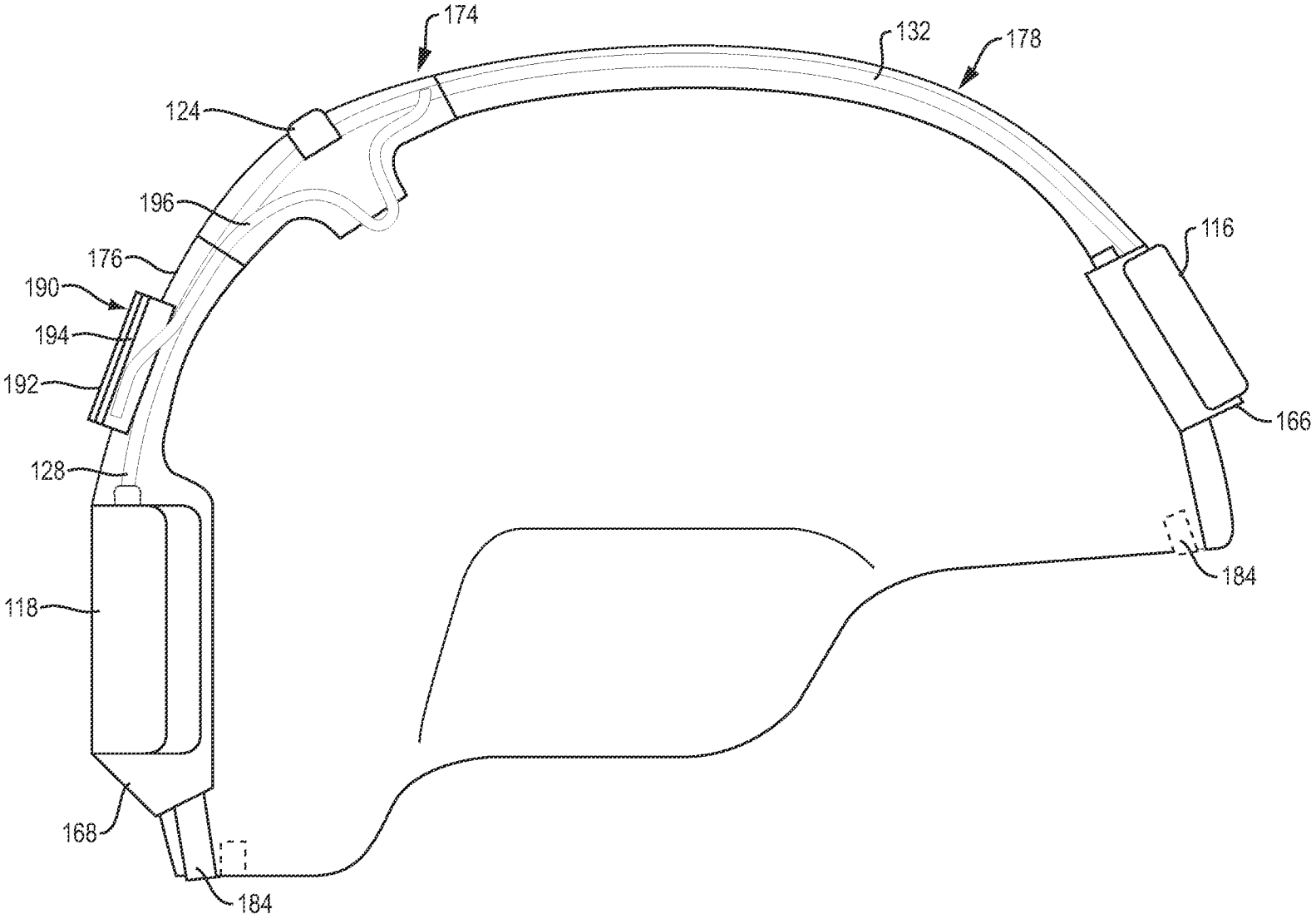
FIG. 9 illustrates an alternative two-leg helmet mounting system embodiment.

Referring now to FIG. 9, there appears an alternative two-leg helmet mounting system embodiment, including a shroud 116 received in a housing 166, a data/power management module 118 received in a housing 168, and an IFF module 124 received in a housing 174. A cable enclosure 178 is attached to the housing 166 and encloses a cable 132 running from the shroud 116 to the IFF module 124. A cable enclosure 176 is attached to the housing 168 and encloses a cable 128 running from the data/power management module 118 to the IFF module 124. Hooks 184 on each of the housings 166 and 168 engage the brim 114 of the shell 112.

The enclosures 176, 178 slidably engage the housing 178 on opposing sides. A tensioning mechanism 190 is secured to the housing section 176, and includes a manually rotatable knob or dial mechanism 192 coupled to a spool 194. In one embodiment, a cinch cord 196 has a first end secured to the spool and a second end secured to the enclosure 178. Alternately, the cord 196 has first and second ends which are secured to the spool, wherein the cord 196 passes through a fastener 198 on the enclosure sections 178. In either instance, rotation of the dial 192 in the tightening direction causes a portion of the cord 196 to be taken up on the spool, thus shortening the effective length of the cord and causing the respective housing sections 176 and 178 to be drawn toward each other. Tension is transferred from the cable to the hooks 184 via the respective housings.

VI. Six Leg System

Figure 10A:
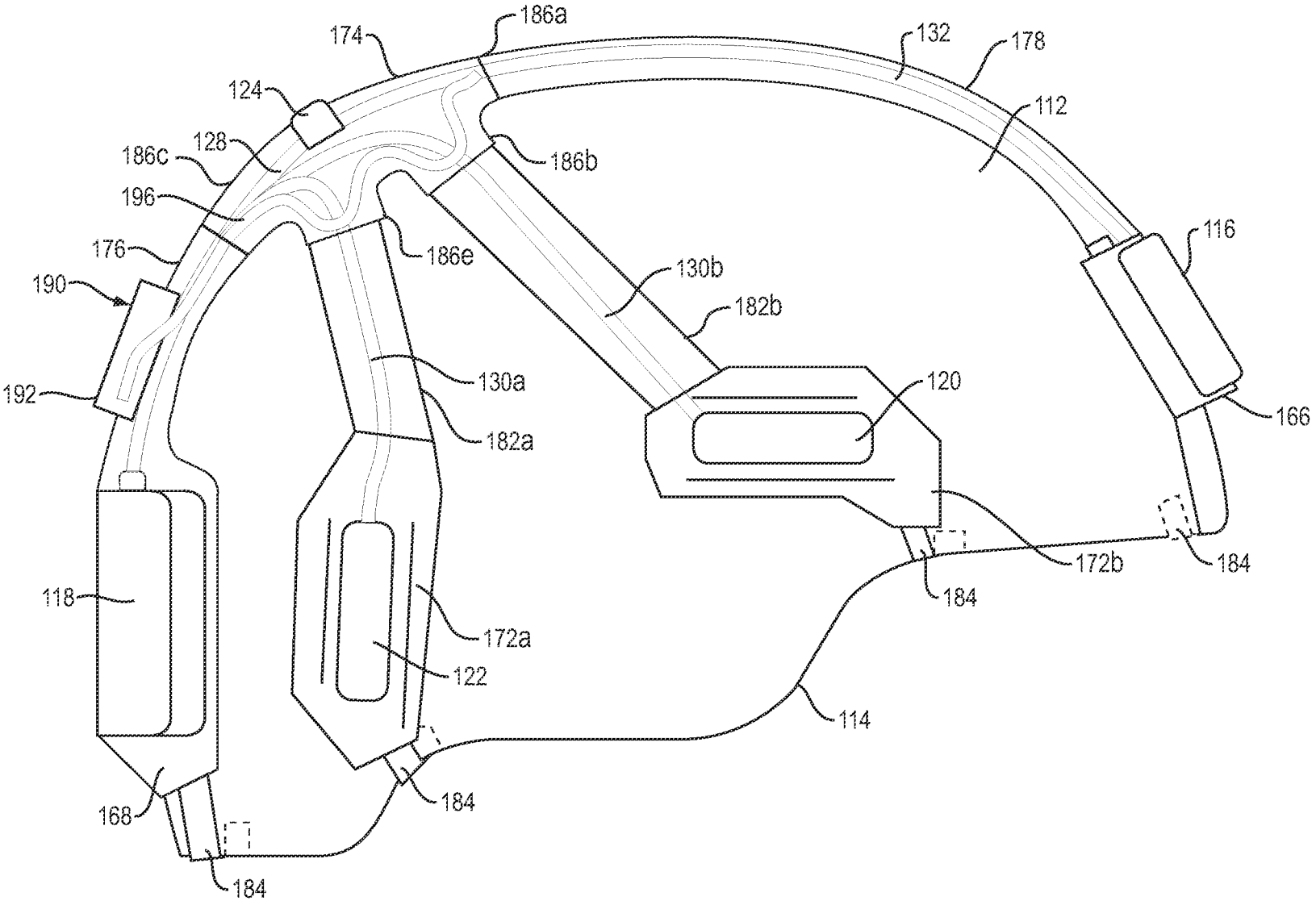
FIGS. 10A and 10B depict right and left side views, respectively, of an exemplary six-leg embodiment, which is a variation of the four-leg embodiment appearing in FIGS. 6A-6D and FIG. 7.
Figure 10B:
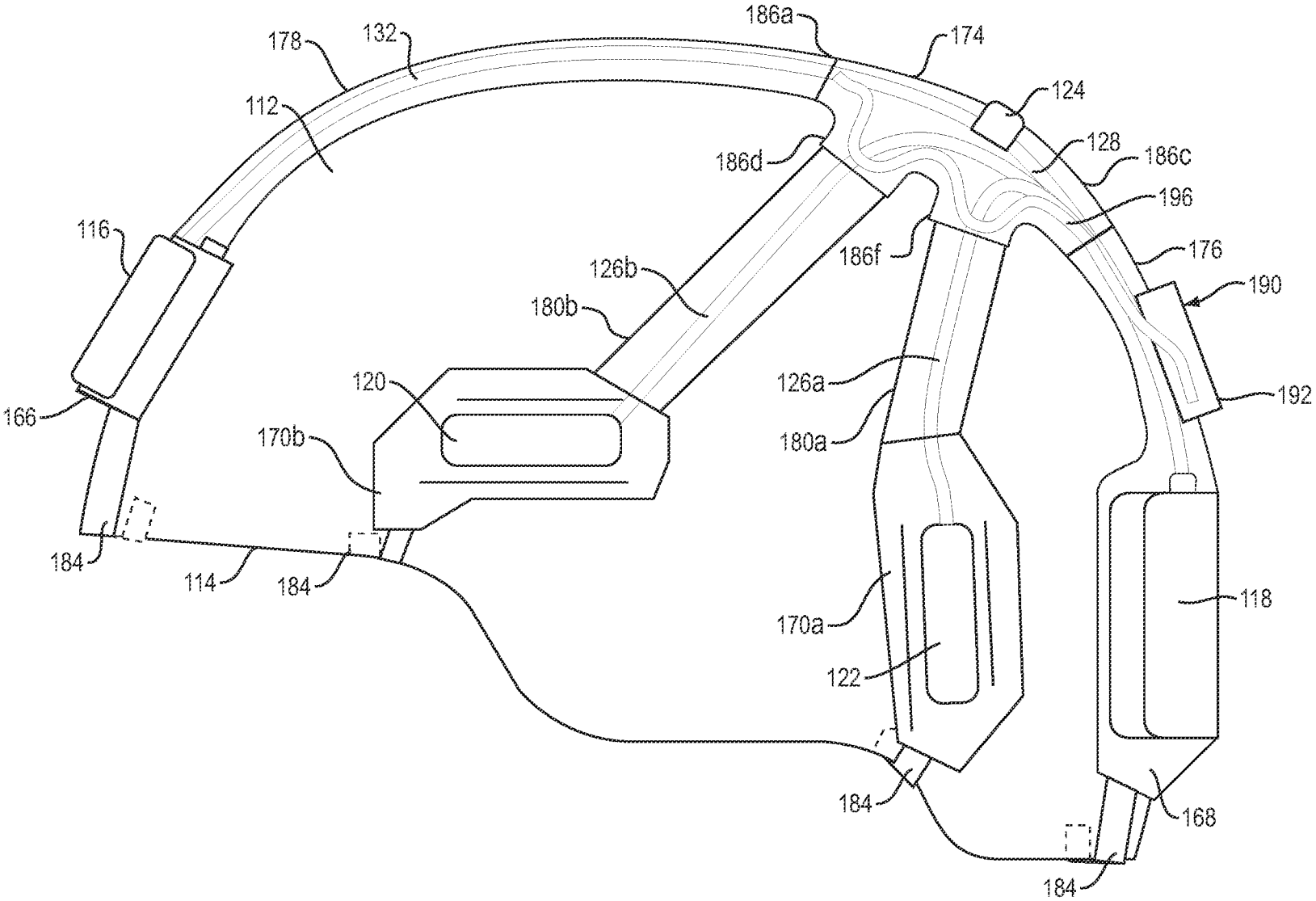

Referring now to FIGS. 10A and 10B, there appears right and left side views, respectively, of a six-leg embodiment, which is a variation of the four-leg embodiment appearing in FIGS. 6A-6D and FIG. 7.

The embodiment of FIGS. 10A and 10B utilizes a high branching concept, as described above, wherein five power/data cables 126*a*, 126*b*, 128, 130*a*, 130*b* each have a first end that is electrically coupled to circuitry within the module 118. Each cable has a plurality of conductors for electrically coupling with corresponding power and data contacts or connectors of the attached accessory devices.

The cable 128 runs from the module 118 along the centerline of the shell 112 to the IFF module 124. A cable 132 in electrical communication with the cable 128 continues along the centerline of the shell 112 to the shroud module 116. The cables 126*a* and 130*a* each run from the module 118 adjacent and parallel to the cables 126*b*, 128, and 130*b* on the left and right sides, respectively. When the cable 126*a* reaches a latitude that is at or near the latitude of the IFF module 124, it is run to the left accessory rail 122. Likewise, when the cable 130*a* reaches a latitude that is at or near the latitude of the IFF module 124, it is run to the right accessory rail 122.

Similarly, the cables 126*b* and 130*b* each run from the module 118 adjacent and parallel to the cable 128 on the left and right sides, respectively, of the cable 128. When the cable 126*b* reaches a latitude that is at or near the latitude of the IFF module 124, it is run to the left accessory rail 120. Likewise, when the cable 130*b* reaches a latitude that is at or near the latitude of the IFF module 124, it is run to the right accessory rail 120.

A first housing member 166 receives the shroud 116 and second housing 168 receiving the power/data management module 118. A side housing 170*a* receives the left side accessory rail interface component 122 and a side housing 170*b* receives the left side accessory rail interface component 122. A side housing 172*a* receives the right side accessory rail component 122 and a side housing 172*b* receives the right side accessory rail interface component 120. An IFF housing 174 receives the IFF beacon 124.

A rear cable enclosure 176 is coupled to the housing 168 and receives the cables 126*a*, 126*b*, 128, 130*a*, and 130*b* running from the power and data management module 118. A front cable housing 178 is coupled to the front housing 166 and receives the cable 132 running from the IFF module 124 to the shroud 116.

A left side cable enclosure 180*a* is coupled to the left housing 170*a* and receives the cable 126*a* running to the left accessory interface 122. A right side cable enclosure 182*a* is coupled to the right housing 172*a* and receives the cable 130*a* running to the right accessory interface 122. A left side cable enclosure 180*b* is coupled to the left housing 170*b* and receives the cable 126*b* running to the left accessory interface 120. A right side cable enclosure 182*b* is coupled to the right housing 172*b* and receives the cable 130*b* running to the right accessory interface 120.

The enclosures or housings 166, 168, 170*a*, 170*b*, 172*a*, 172*b*, 174, 176, 178, 180*a*, 180*b*, 182*a*, and 182*b* may be formed of a polymer material or a composite material such as a fiber reinforced composite material comprising fiber reinforcements in a polymer matrix. Enclosures 166 and 178 may be integrally formed or separately formed and attached. Enclosures 168 and 176 may be integrally formed or separately formed and attached. Enclosures 170*a* and 180*a* may be integrally formed or separately formed and attached. Enclosures 170*b* and 180*b* may be integrally formed or separately formed and attached. Enclosures 172*a* and 182*a* may be integrally formed or separately formed and attached. Enclosures 172*b* and 182*b* may be integrally formed or separately formed and attached.

In certain embodiments, each of the housing members 166, 168, 170*a*, 170*b*, 172*a*, and 172*b* includes one or more, preferably two or more, and most preferably two hooks 184 which are sized to wrap around and engage the brim 114 of the helmet shell 112 and a tensioning mechanism is provided to selectively apply tension to secure the hooks to the brim 114 and selectively release tension for removal of the accessory components.

The housing 174 includes six radially extending arms 186*a*, 186*b*, 186*c*, 186*d*, 186*e*, and 186*f*, each of which defines a channel or track. The arm 186*a* slidably engages the housing section 178. The arm 186*b* slidably engages the housing section 182*b*. The arm 186*c* slidably engages the housing section 176. The arm 186*d* slidably engages the housing section 180*b*. The arm 186*e* slidably engages the housing section 182*a*. The arm 186*f* slidably engages the housing section 180*a*.

In the illustrated embodiment, a tensioning mechanism 190 is secured to the housing section 176, which may be as described above. The tensioning mechanism 190 includes a manually rotatable knob or dial mechanism 192 coupled to a spool 194. A cinch cord 196 has first and second ends which are secured to the spool. The cord 196 passes through a series of cable guides 198, such as openings, loops, hooks, or the like in the respective housing sections 178, 182*a*, 182*b*, 176, 180*a*, and 180*b*. Rotation of the dial 192 in the tightening direction causes a portion of the cord 196 to be taken up on the spool 194, thus shortening the effective length of the cord and causing the respective housing sections 178, 182*a*, 182*b*, 176, 180*a*, and 180*b* to be drawn toward each other. Tension is transferred from the cable to the hooks 184 via the respective housings. The cord 196 and/or hooks 198 are preferably formed of a low friction material to ensure that tension is distributed equally to the respective housing sections 178, 182*a*, 182*b*, 176, 180*a*, and 180*b*.

VII. Tensioning Cable Variations

In the embodiments, appearing in FIGS. 6A-6D, 7, 9, 10A, and 10B, the cinch cord 196 is attached to the various housing members, such that tension is transferred to the retention hooks 184 via the housings/enclosures. In alternative embodiments, however, the tension cable 196 extends through the housing components and attached directly to the hooks.

Referring now to FIGS. 11A-11C, FIG. 11A shows an exemplary hook 184*a* configured to attach directly to a tension cable. The hook 184*a* includes a channel 200 sized to receive the brim 114 of the helmet shell 112. To provide removable attachment of the hook to the cable, an elongated, generally keyhole shaped opening 202 having an enlarged diameter opening at a distal end 204 and being narrower at a proximal end 206. FIGS. 11B and 11C are front and side views, respectively, showing a cinching cable 196 secured within the opening 202. The cable 196 has a ball 208 securely attached to the cable distal end, e.g., by crimping or other method of attachment. The ball 208 is sized to fit through the enlarged diameter portion 204. The width of the narrow end 206 of the opening 202 is sized to receive the cable while preventing the ball 208 from passing therethrough when tension is applied to the cable.

Figure 12:
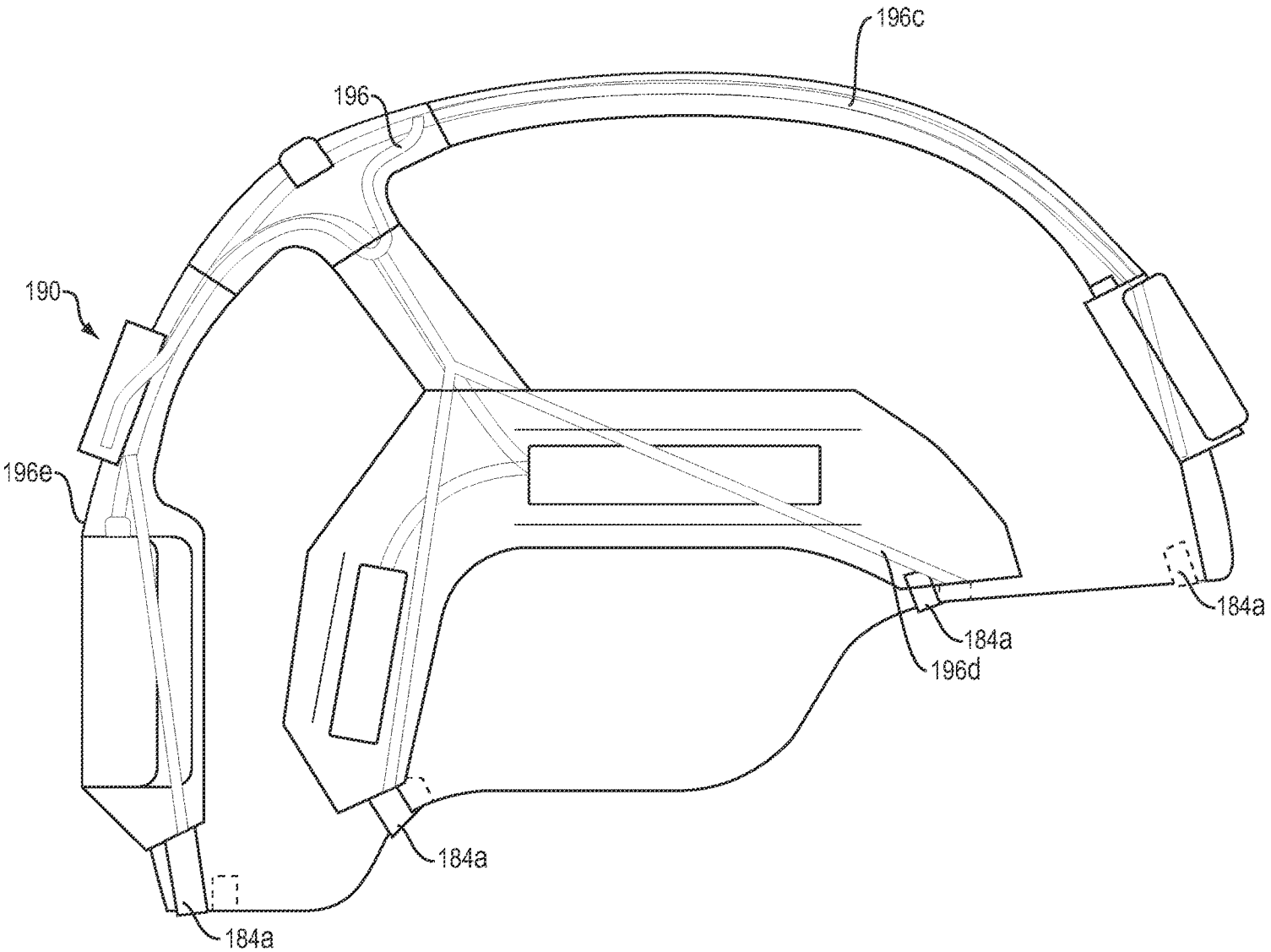
FIG. 12 illustrates an alternative embodiment similar to the embodiment appearing in FIGS. 6A-6D and FIG. 7, but wherein the integral hooks are replaced with separate hooks attached to the respective housings, and the cinching cable further includes extensions which extend and connect directly to the hooks.

Referring now to FIG. 12, there is shown yet another embodiment, which differs from the embodiment of FIGS. 6A-6D and FIG. 7 in that the integral hooks 184 are replaced with separate hooks attached to the respective housings, and the cinching cable 196 further includes extensions 196*c*, 196*d*, and 196*e* that extend and connect directly to the hooks 184*a*. In the depicted embodiment, the extensions 196*c*, 196*d*, and 196*e* are branched to accommodate two hooks at spaced apart positions on the respective housing where it engages the brim. The manner of connection of the cable extensions 196*c*, 196*d*, and 196*e* to the hooks 184*a* may be as shown in FIGS. 11A-11C. In all other respects, the embodiment of FIG. 12 is as described above by way of reference to FIGS. 6A-6D and FIG. 7, which description is equally applicable here. It will be recognized that the other embodiments described herein may likewise be modified in this manner to utilize a direct attachment of the tensioning cable to the hooks.

Figures 13, 13A:
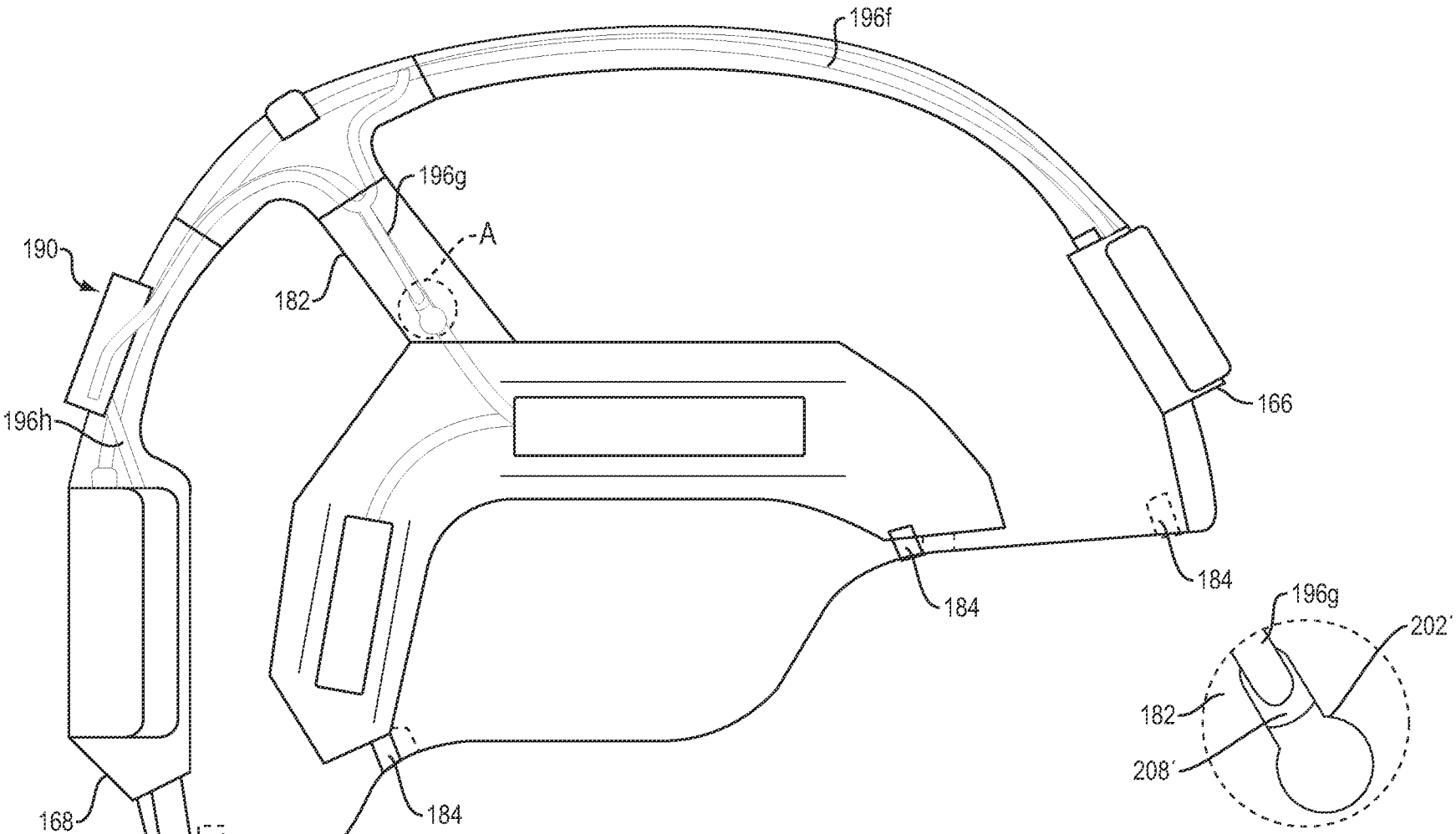
FIG. 13 illustrates a further alternative embodiment which is a hybrid of the embodiments appearing in FIG. 12 and the embodiment appearing in FIGS. 6A-6D and FIG. 7.
FIG. 13A is an enlarged view of the region A appearing in FIG. 13.

Referring now to FIG. 13, there is shown yet another embodiment, which is a hybrid of the FIG. 12 embodiment and the embodiment of FIGS. 6A-6D and FIG. 7. The embodiment of FIG. 13 retains the integral hooks 184 of FIGS. 6A-6D and FIG. 7, but also incorporates cinching cable extensions 196*f*, 196*g*, and 196*h*. However, the embodiment of FIG. 13 differs in that the extensions 196*f*, 196*g*, and 196*h* do not extend all the way to the hooks, but rather, terminate before reaching the hooks and engage a complementary feature formed in the respective housing/enclosure wall. In this manner, the tension is transmitted to the hooks through the housing/enclosure members. FIG. 13A is an enlarged view of the region A appearing in FIG. 13 showing a keyhole feature 202' for receiving a ball end 208' in the extension 196*g*. The extensions 196*f* and 196*h* connect to their respective enclosures 166, 168, and 180 in like fashion. It will be recognized that the other embodiments here may likewise be modified in this manner to utilize the illustrated hybrid tensioning cable system. In alternative embodiments, the cables 196*g* may extend all the way to the housings 170, 172, as shown and described by way of reference to FIGS. 18A and 18B.

Figure 14:
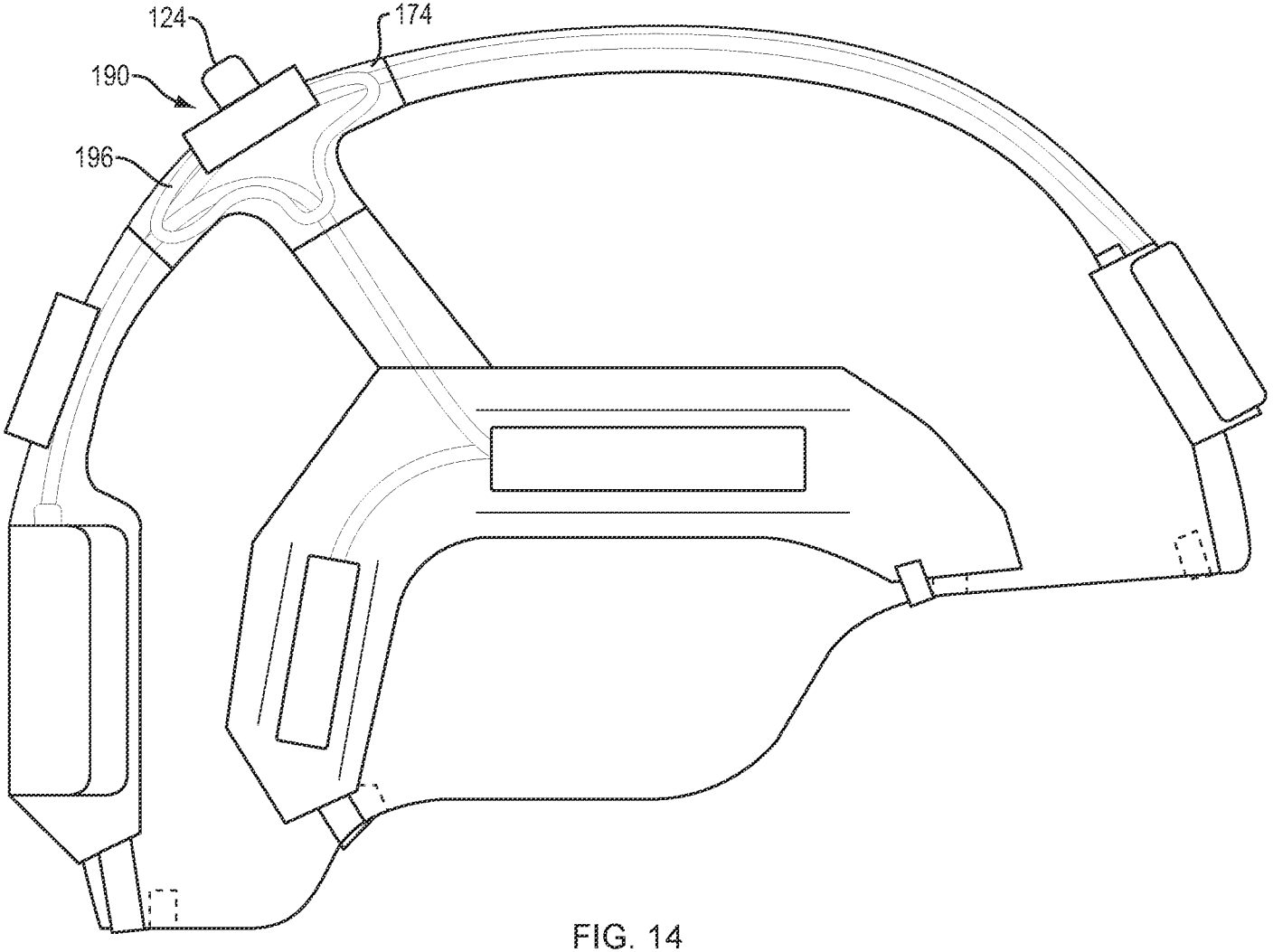
FIG. 14 shows an alternative embodiment which differs from the embodiment of FIGS. 6A-6D and FIG. 7 in that the tensioning mechanism is disposed at the IFF module housing where the housing legs intersect.

Referring now to FIG. 14, there is shown yet another embodiment, which differs from the embodiment of FIGS. 6A-6D and FIG. 7 in that the tensioning mechanism 190 is disposed at the IFF module housing 174 where the housing legs 176, 178, 180, and 182 intersect. In all other respects, the embodiment of FIG. 14 is as described above by way of reference to FIGS. 6A-6D and FIG. 7, which description is equally applicable here. It will be recognized that the other embodiments here may likewise be modified to position the cable tensioning mechanism 190 at the leg intersection in the manner shown in FIG. 14.

Figure 15:
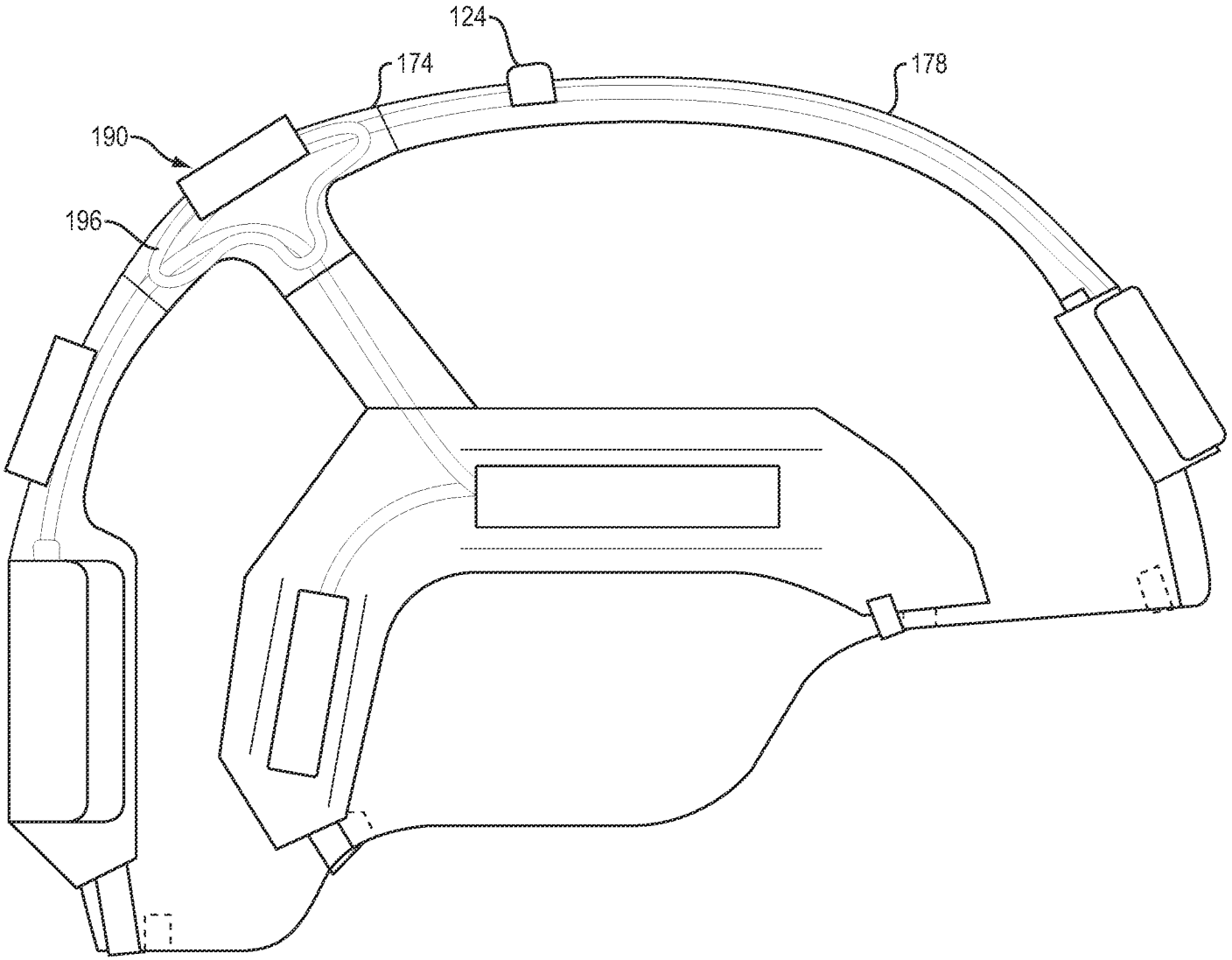
FIG. 15 shows yet another alternative embodiment which differs from the embodiment of FIG. 14 in that the IFF module is to a position higher on the crown of the shell.

Referring now to FIG. 15, there is shown yet another embodiment, which differs from the embodiment of FIG. 14 in that the IFF module 124 is moved from the housing 174 to the housing 178 at a position higher on the crown of the shell 112, while the tensioning mechanism 190 remains at IFF module housing 174 where the legs 176, 178, 180, and 182 intersect. In all other respects, the embodiment of FIG. 15 is as described above by way of reference to FIG. 14, which description is equally applicable here. It will be recognized that the other embodiments here may likewise be modified in a similar manner.

VIII. Power and Tensioning Variations

Figure 16:
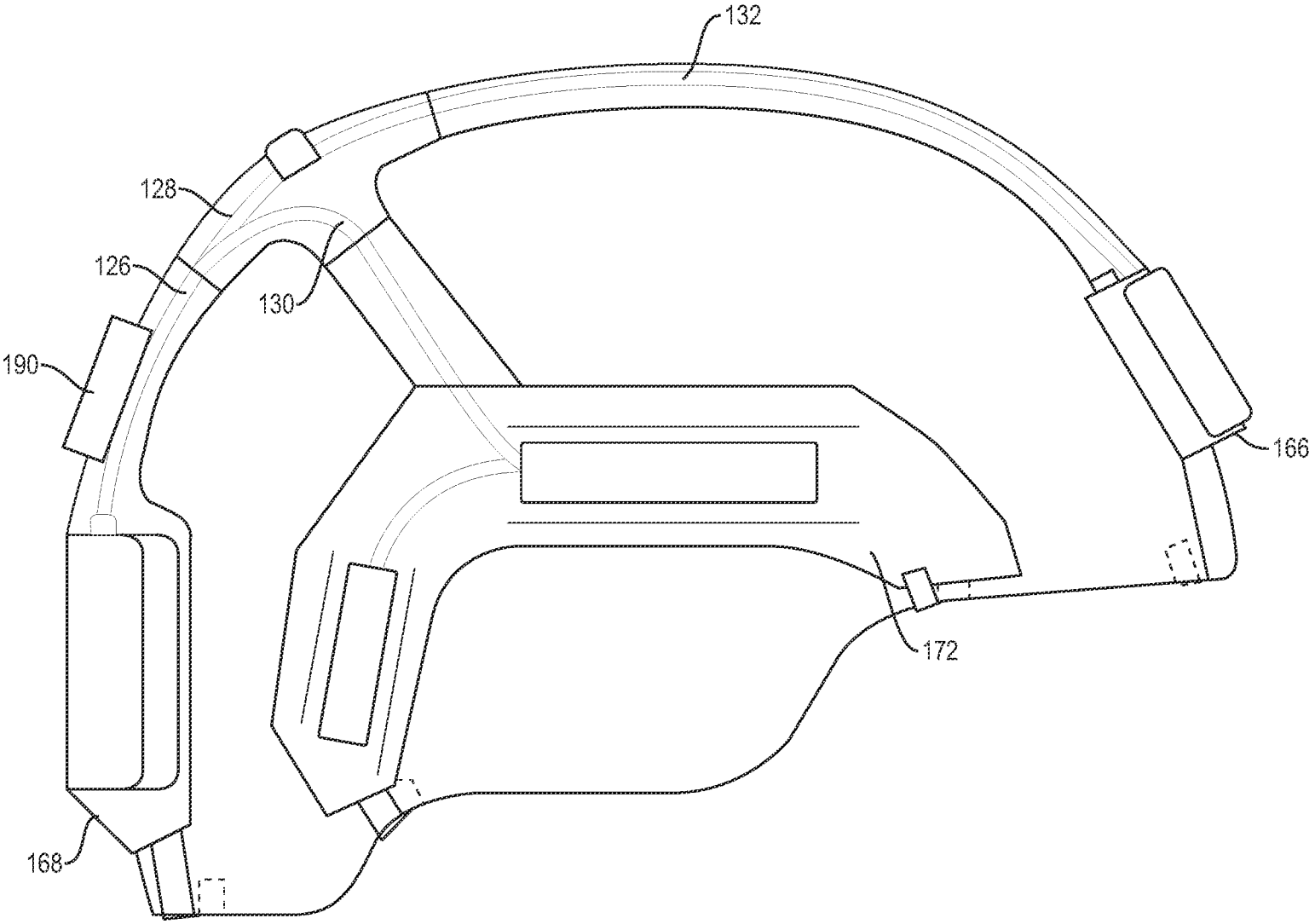
FIG. 16 shows still another embodiment which is a variation of the embodiment appearing in FIGS. 6A-6D and FIG. 7 but wherein the power/data cables additionally serve to provide tensioning.

Referring now to FIG. 16, there is shown yet another embodiment which is a variation of the embodiment appearing in FIGS. 6A-6D and FIG. 7. In the embodiment appearing in FIGS. 6A-6D and FIG. 7, the power/data cables and the tensioning cable are separate entities. In contrast, in the embodiment of FIG. 16, the power/signal cables are coupled to the spool 194 of the tension assembly 190, wherein the cables 126, 128, 130, and 132 additionally serve to provide tensioning of the housing members 166, 168, 170, and 172. In all other respects, the embodiment of FIG. 16 is as described above by way of reference to FIGS. 6A-6D and FIG. 7, which description is equally applicable here. It will be recognized that the other embodiments here may likewise be modified in this manner to utilize the data/power cables to supply tension for securing the housing members to the helmet.

IX. High Speed Copper Variations

Figure 17B:
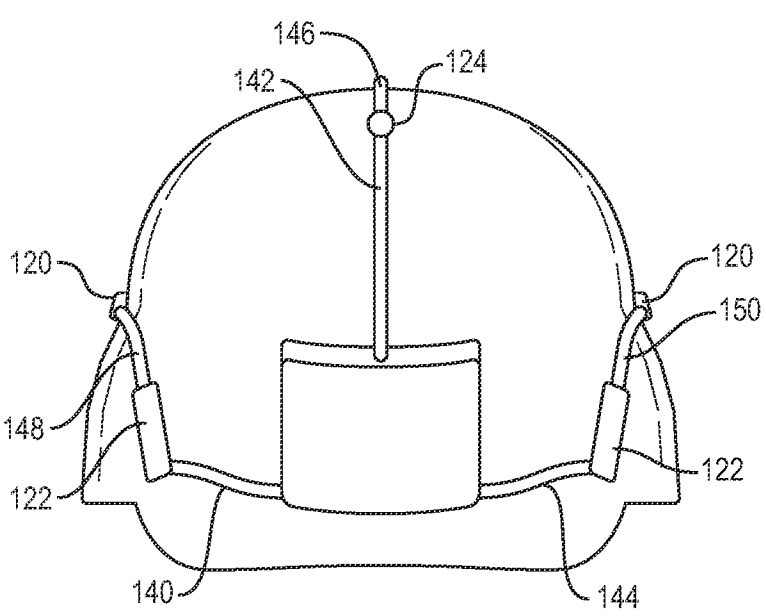
FIGS. 17A and 17B are enlarged views of FIGS. 3B and 3C, respectively.
Figure 17A:
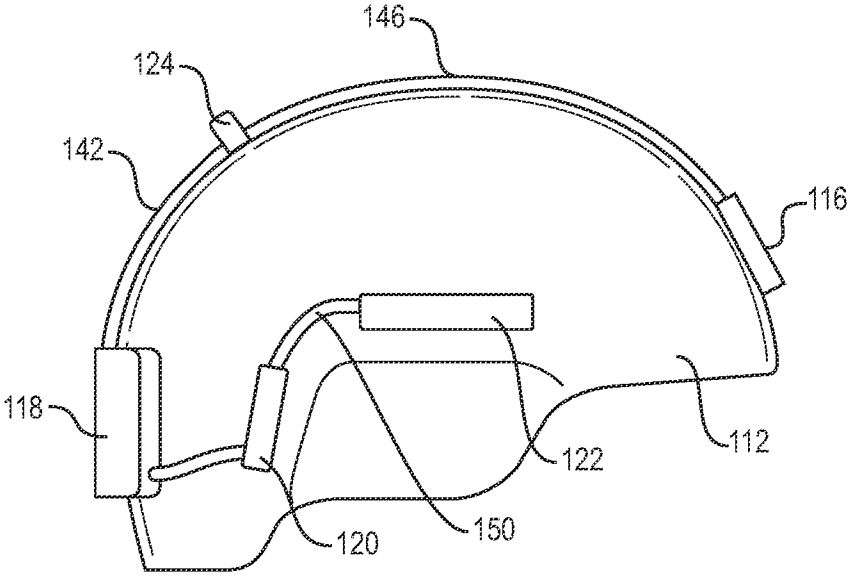

The embodiments described above by way of reference to FIGS. 2A-10B and 12-16, and in particular FIGS. 3A-3D, are illustrated with standard power and data distribution cables, e.g., round cables, with standard electrical connectors. FIGS. 17A and 17B are enlarged views of FIGS. 3B and 3C, respectively.

Figure 18B:
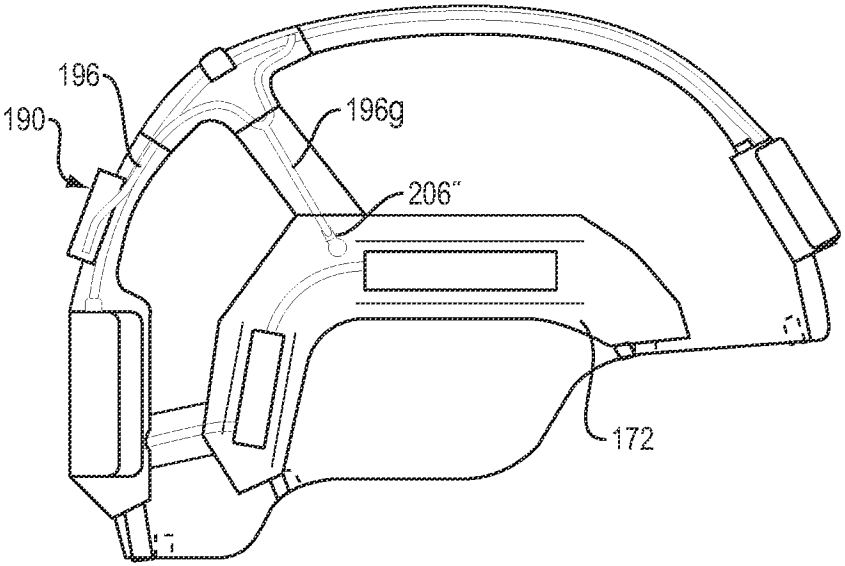
FIGS. 18A and 18B illustrate an alternative embodiment wherein the cinching cables may extend all the way to the respective housings.
Figure 18A:
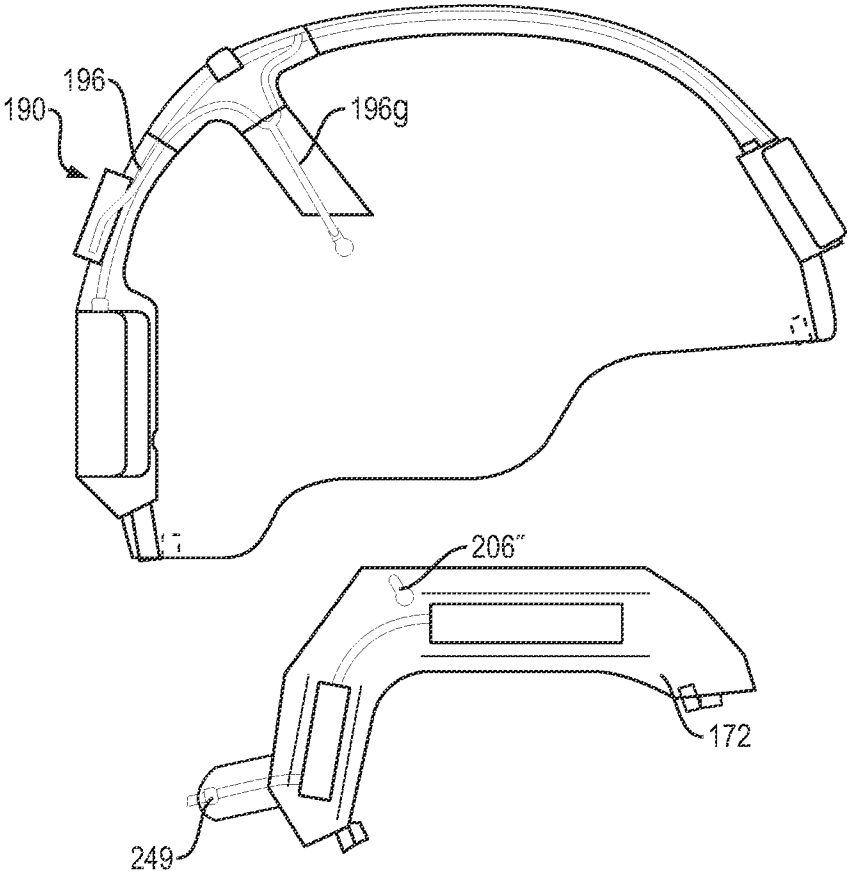

FIGS. 18A and 18B show an exemplary embodiment with the low branching conductor routing pattern as shown in FIGS. 17A and 17B, showing the right side accessory rails 120, 122, and the associated housing member 172 removed and attached, respectively. The embodiments illustrated in FIGS. 17A, 17B, 18A, and 18B utilize standard power and data distribution cables, e.g., round cables, with standard electrical connectors, such as connector 249 and is illustrated with the housing/enclosure members and cinch mechanism. FIGS. 18A and 18B also demonstrate the manner in which a cinch cord 196*g* engages a keyhole feature 208" formed in the housings 170 (not shown) and 172.

Figure 19B:
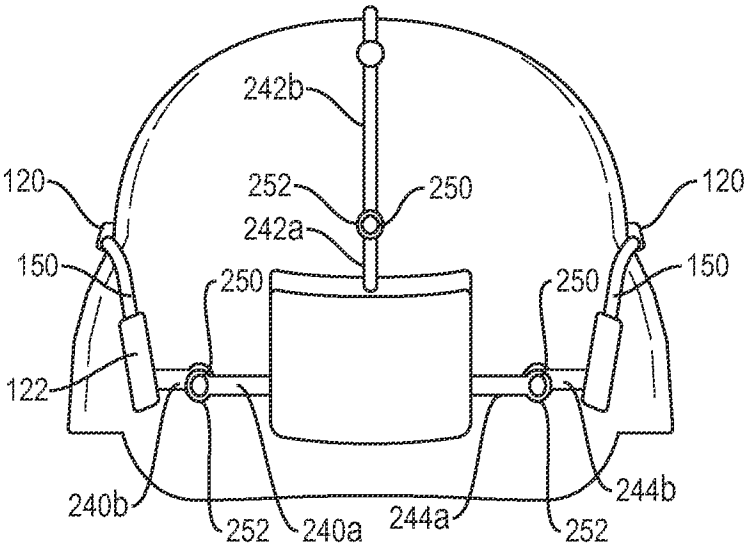
FIGS. 19A and 19B illustrate an alternative embodiment employing a "low branching" power and data conductor routing pattern.
Figure 19A:
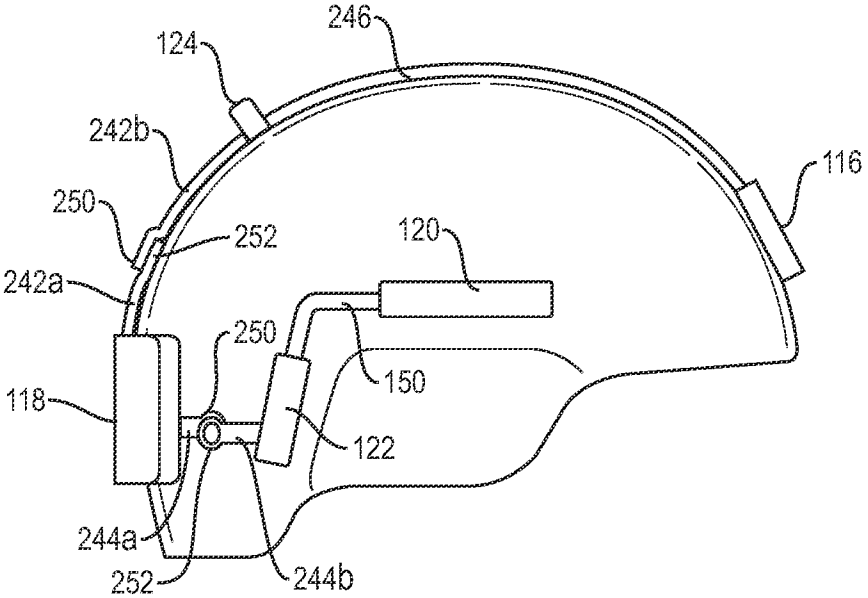

Referring now to FIGS. 19A and 19B, there is shown an alternative exemplary embodiment with a low branching conductor routing pattern. The embodiment of FIGS. 19A and 19B is similar to the embodiment of FIGS. 18A and 18B, except that the standard cables and connectors are replaced with flex circuits 240, 242, 244, 246, and 248. The flex circuits comprise circuit components on a flexible substrate, such as a polymer film substrate. Connections between the flex circuits are made with mating connector pairs 250, 252 where in one of the connectors comprises a plurality of pin terminals, e.g., spring biased pogo pin terminals, and the other connector comprises a plurality of aligned contact pad terminals. An exemplary configuration appears in FIGS. 36 and 37.

Figure 20B:
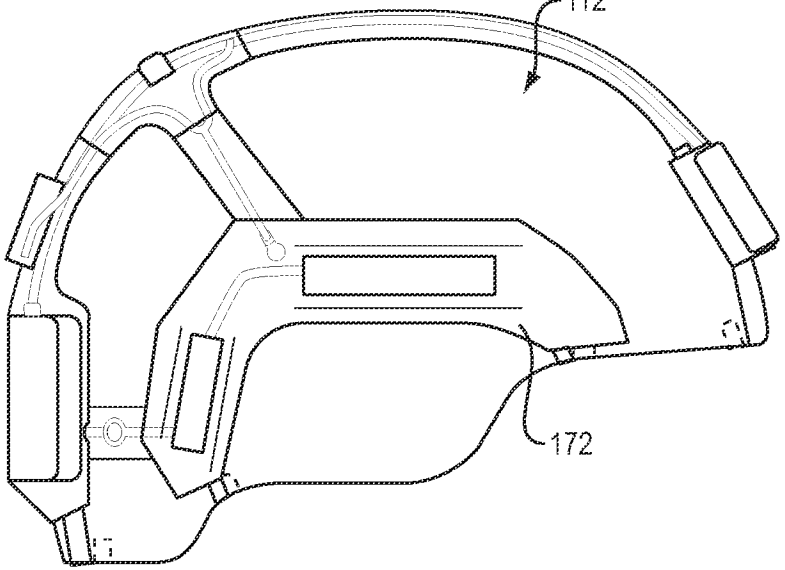
FIGS. 20A and 20B illustrate the embodiment appearing in FIGS. 19A and 19B with the housing/enclosure members and cinch mechanism in place, showing the right side accessory rails and the associated housing member removed and attached, respectively
Figure 20A:
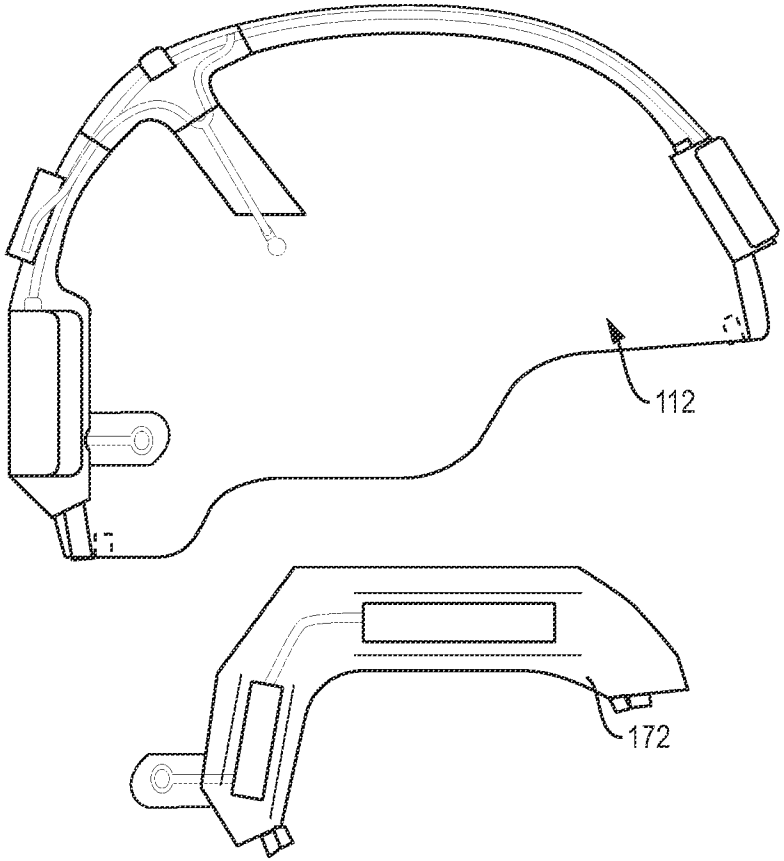

FIGS. 20A and 20B illustrate the embodiment of FIGS. 19A and 19B with the housing/enclosure members and cinch mechanism in place, showing the right side accessory rails 120, 122, and the associated housing member 172 removed and attached, respectively.

X. Flex Circuit Variations

Figure 21:
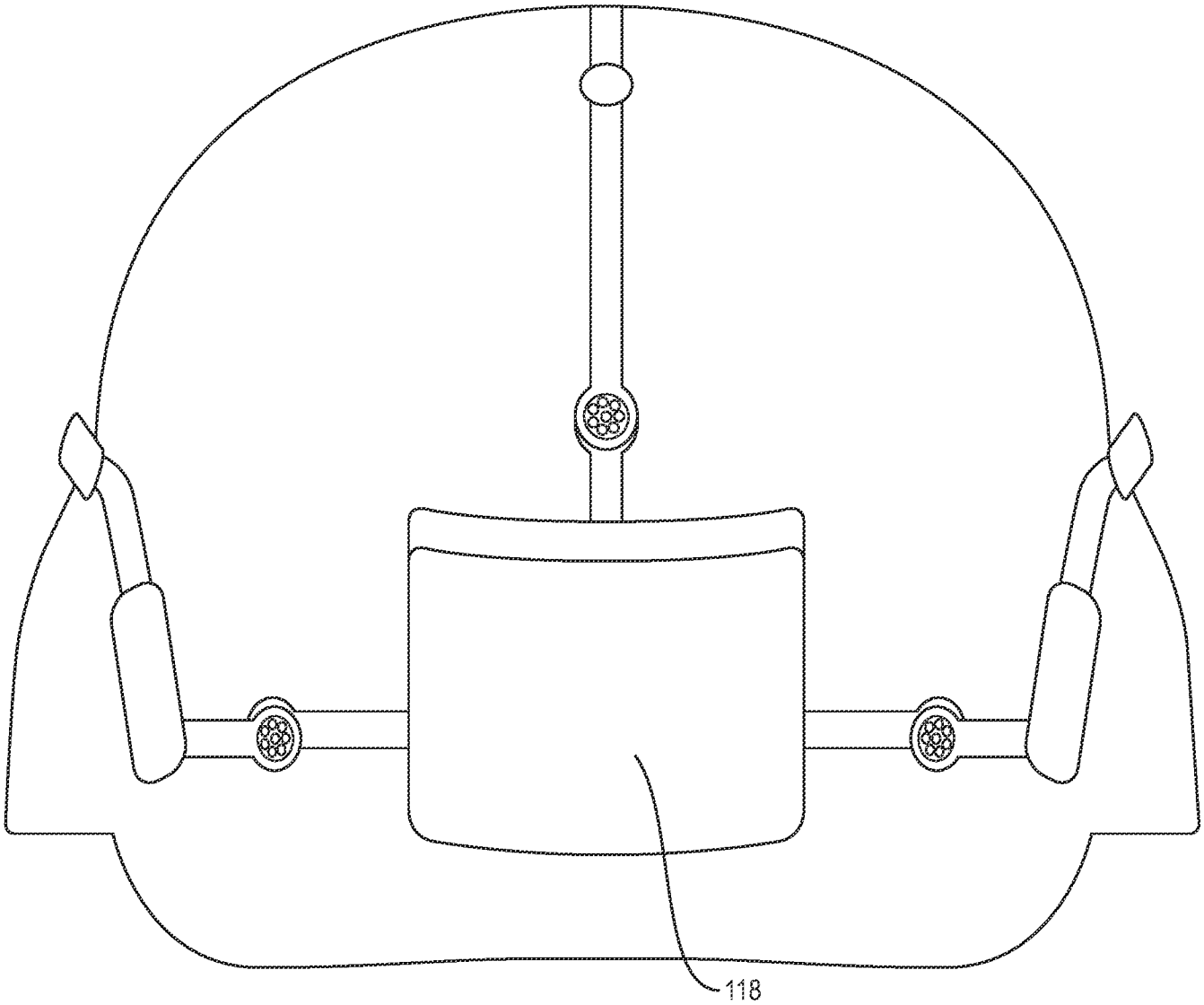
FIG. 21 shows an enlarged view of FIG. 19B, which illustrates an exemplary low branching embodiment wherein the flex circuits emanate from a rear power/data management module.

Referring now to FIG. 21, there is a shown an enlarged view of FIG. 19B, which shows an exemplary low branching embodiment wherein the flex circuits emanate from a rear power/data management module 118.

Figure 22:
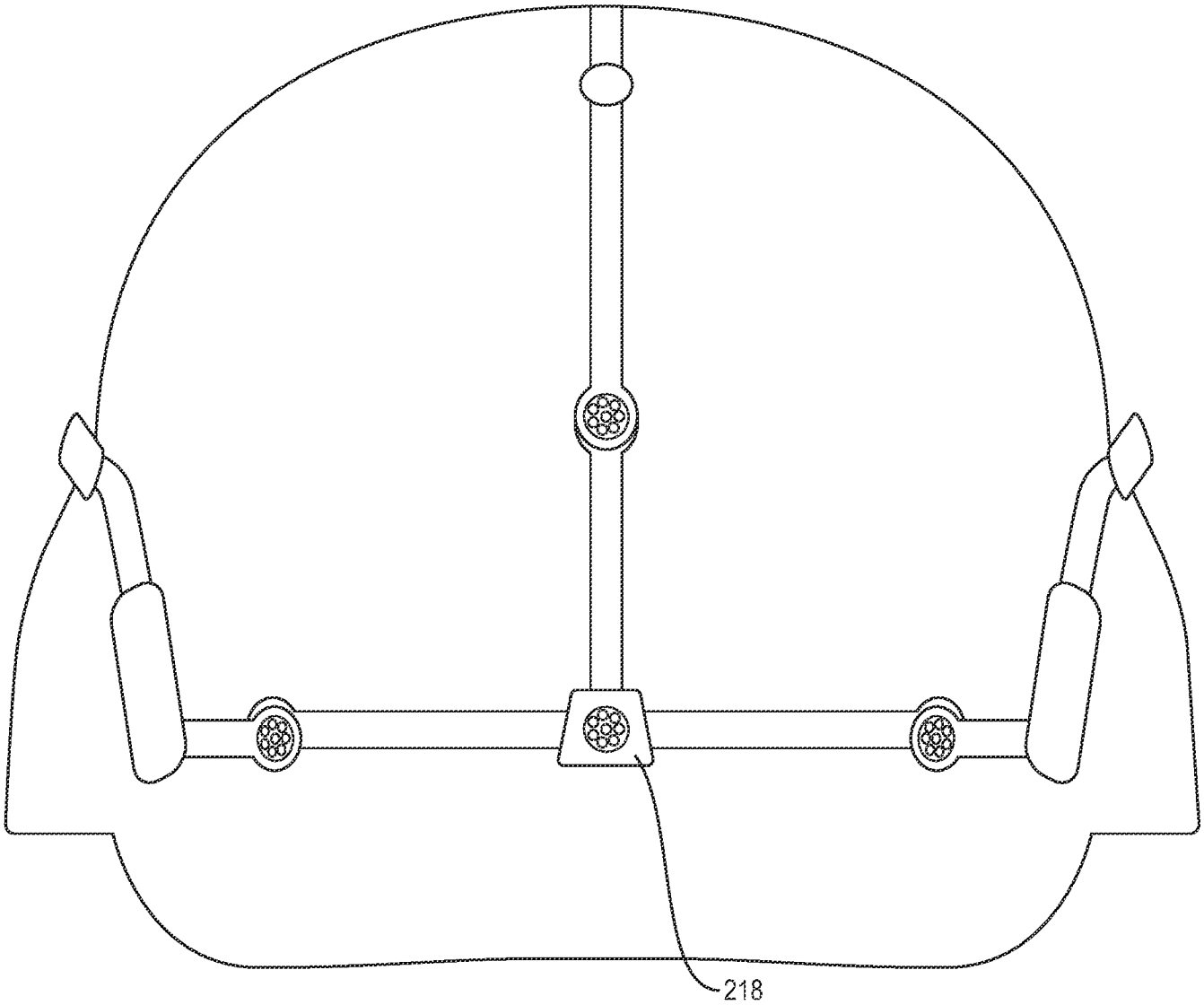
FIG. 22 shows an alternative embodiment wherein the flex circuits emanate from a rear hot shoe.

Referring now to FIG. 22, there is shown an alternative embodiment wherein the flex circuits emanate from a rear hot shoe 218. The hot shoe 218, in turn, may be removably connected to a power and data management module 118*a* (see FIG. 26). The rear hot shoe 218 may be as described in U.S. Patent Application Publication US2020/0225488 published Jul. 16, 2020, which is incorporated herein by reference in its entirety.

XI. Rear Hot Shoe Variations

Figure 23:
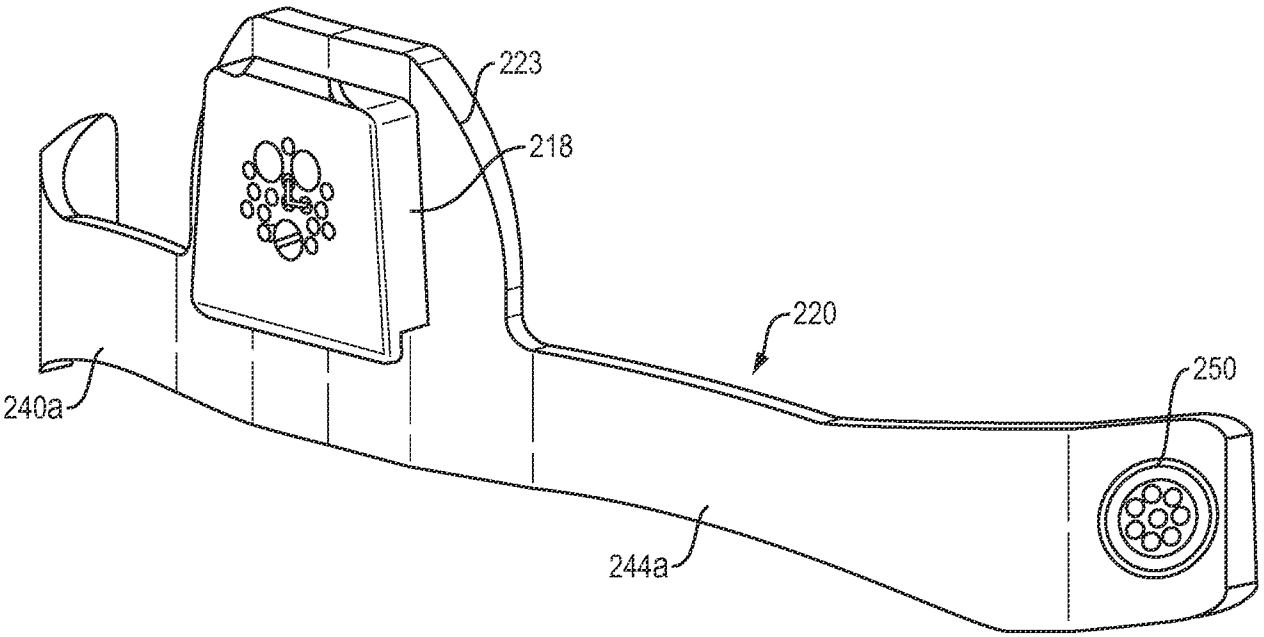
FIG. 23 shows an exemplary hot shoe assembly with a hot shoe disposed on a substrate having flex boards extending therefrom.
Figure 24:
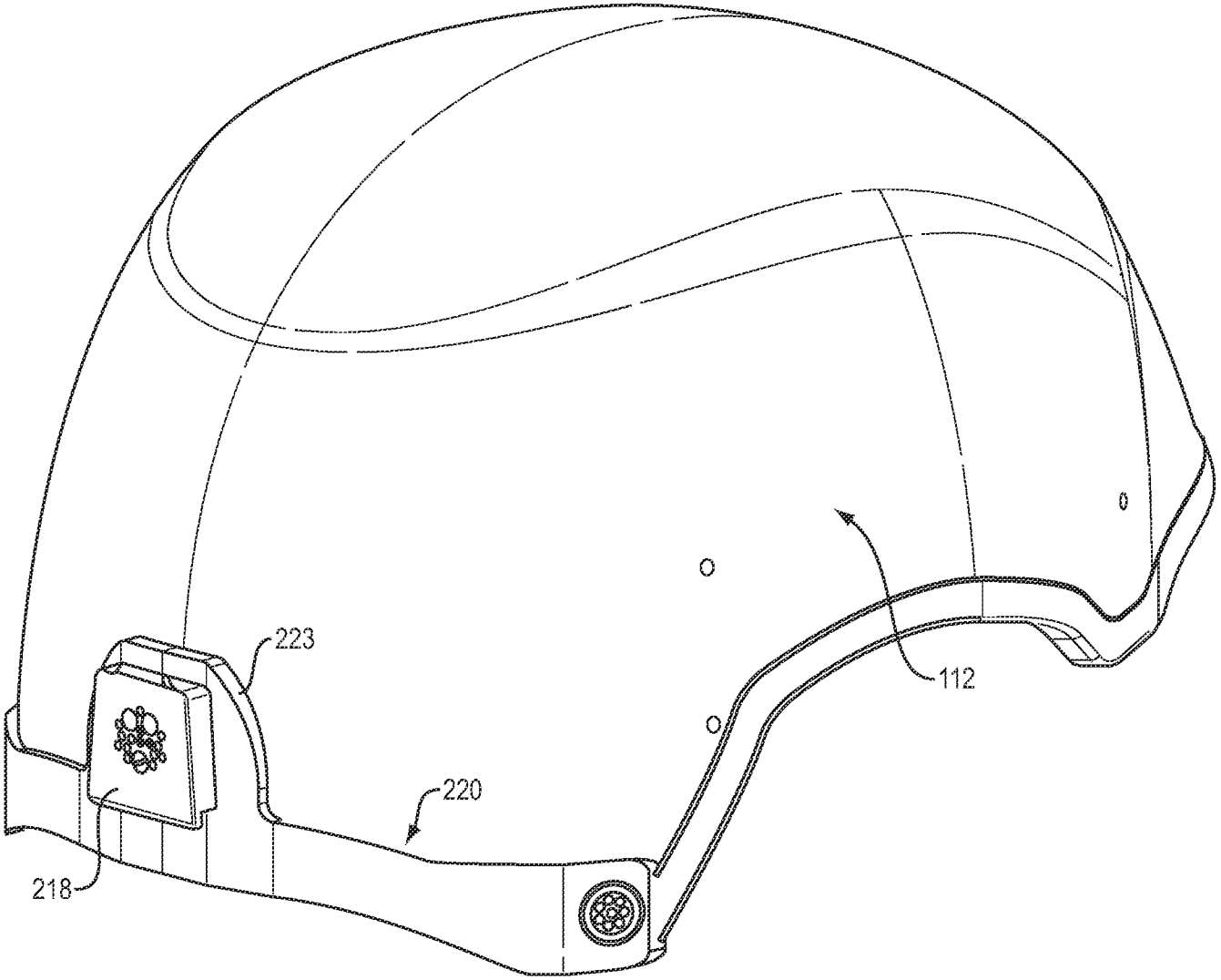
FIG. 24 is a rear isometric view of the hot shoe assembly disposed on a rear portion of a helmet shell.
Figure 25:
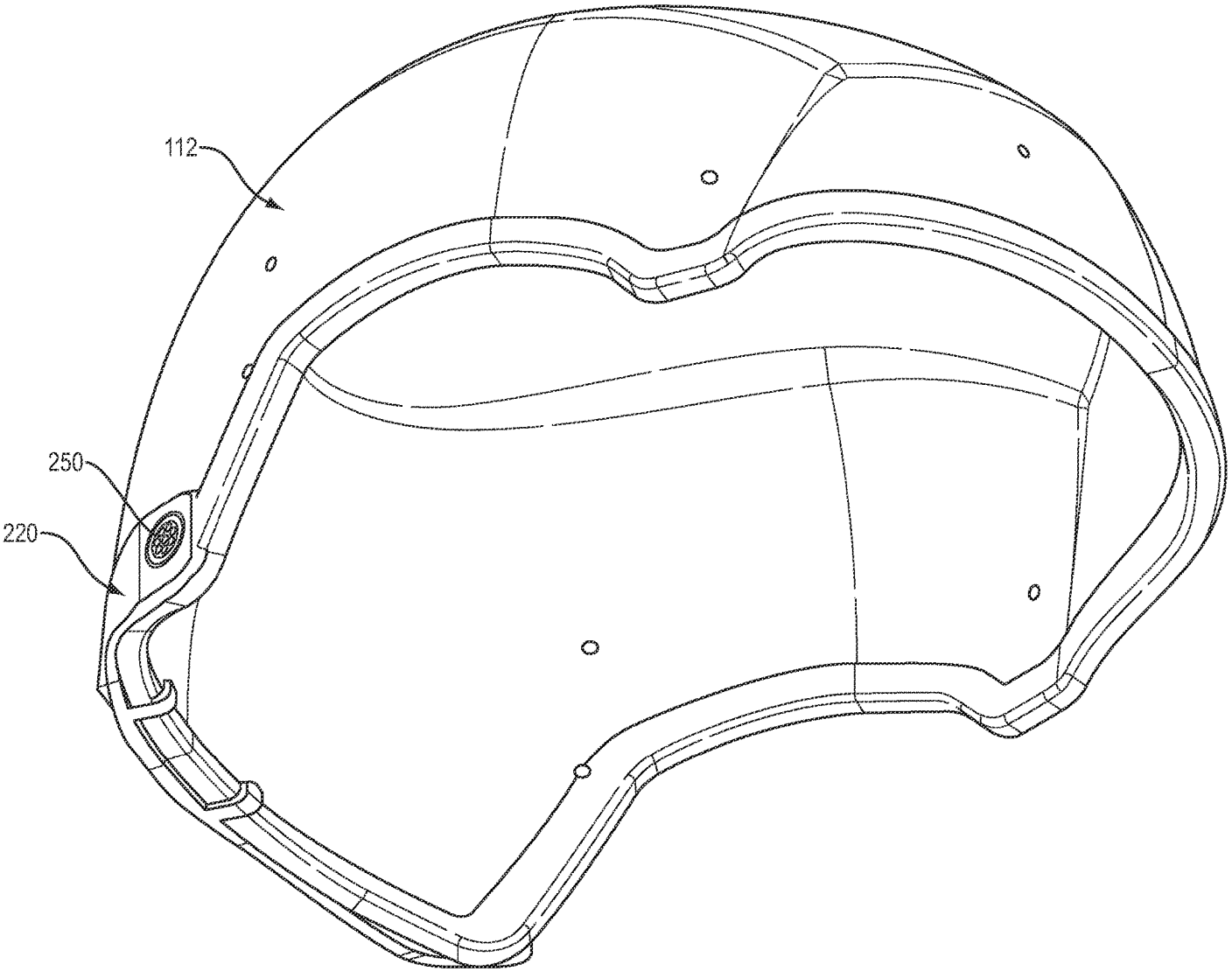
FIG. 25 is an isometric view taken generally from the side and bottom, illustrating the hot shoe assembly disposed on a rear portion of a helmet shell and showing the hooks for securing the assembly to the brim of the shell.
Figure 26:
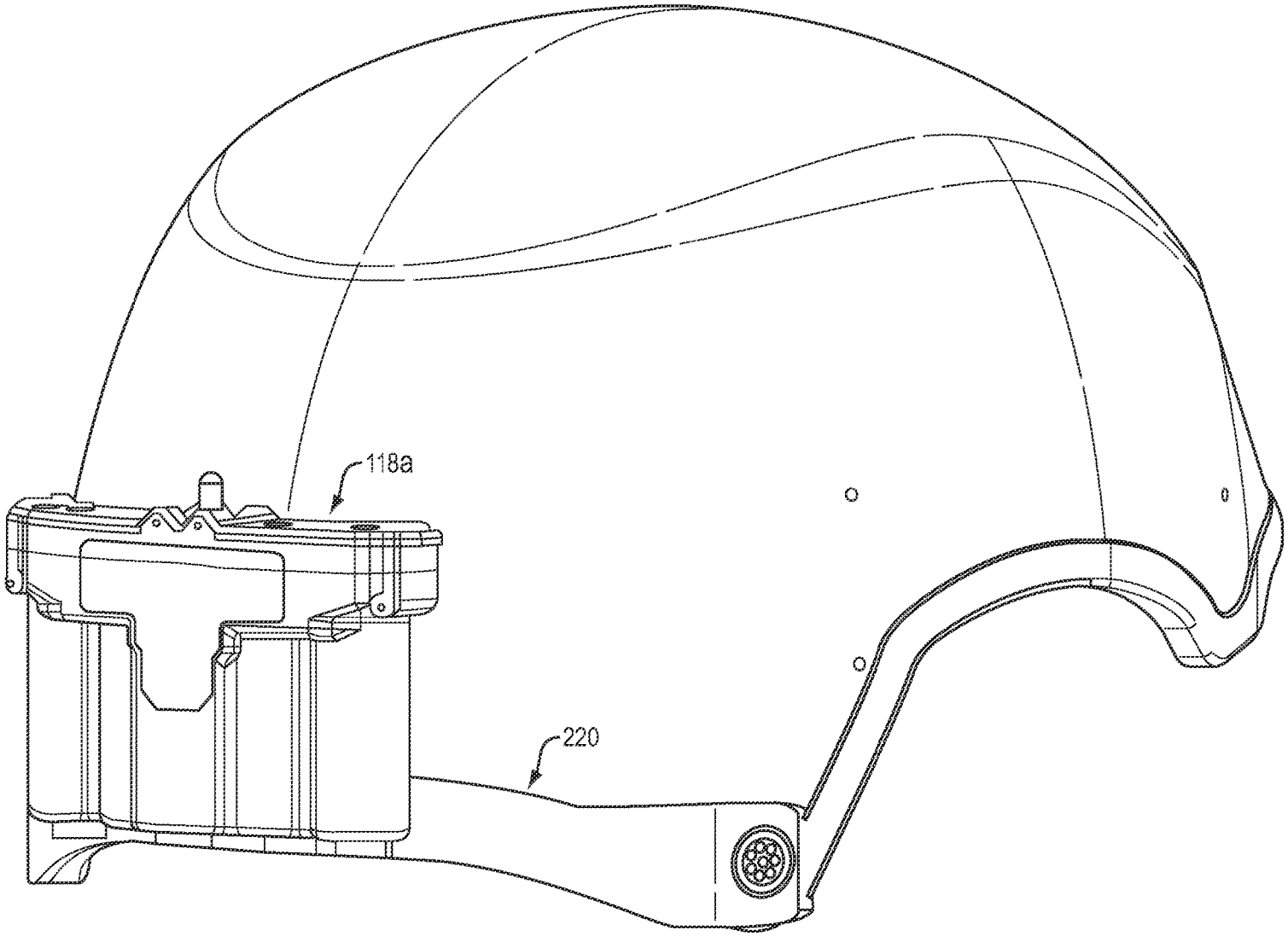
FIG. 26 illustrates the helmet embodiment appearing in FIG. 24 having a battery pack removably attached to the hot shoe.

Referring now to FIG. 23, there is shown an exemplary hot shoe assembly 220 operable to embody the present development, with a hot shoe 218 disposed on a substrate 223 having flex boards 240*a*, 244*a* emanating therefrom, wherein each flex board has connector elements 250 thereon. FIG. 24 is a rear isometric view of the hot shoe assembly 220 disposed on a rear portion of a helmet shell 112. FIG. 25 is an isometric view taken generally from the side and bottom, illustrating the hot shoe assembly 220 disposed on a rear portion of a helmet shell 112 and showing the hooks 184 for securing the assembly 220 to the brim 114 of the shell 112. FIG. 26 illustrates the helmet embodiment appearing in FIG. 24 having a battery pack 118*a* removably attached to the hot shoe 218.

Figure 27:
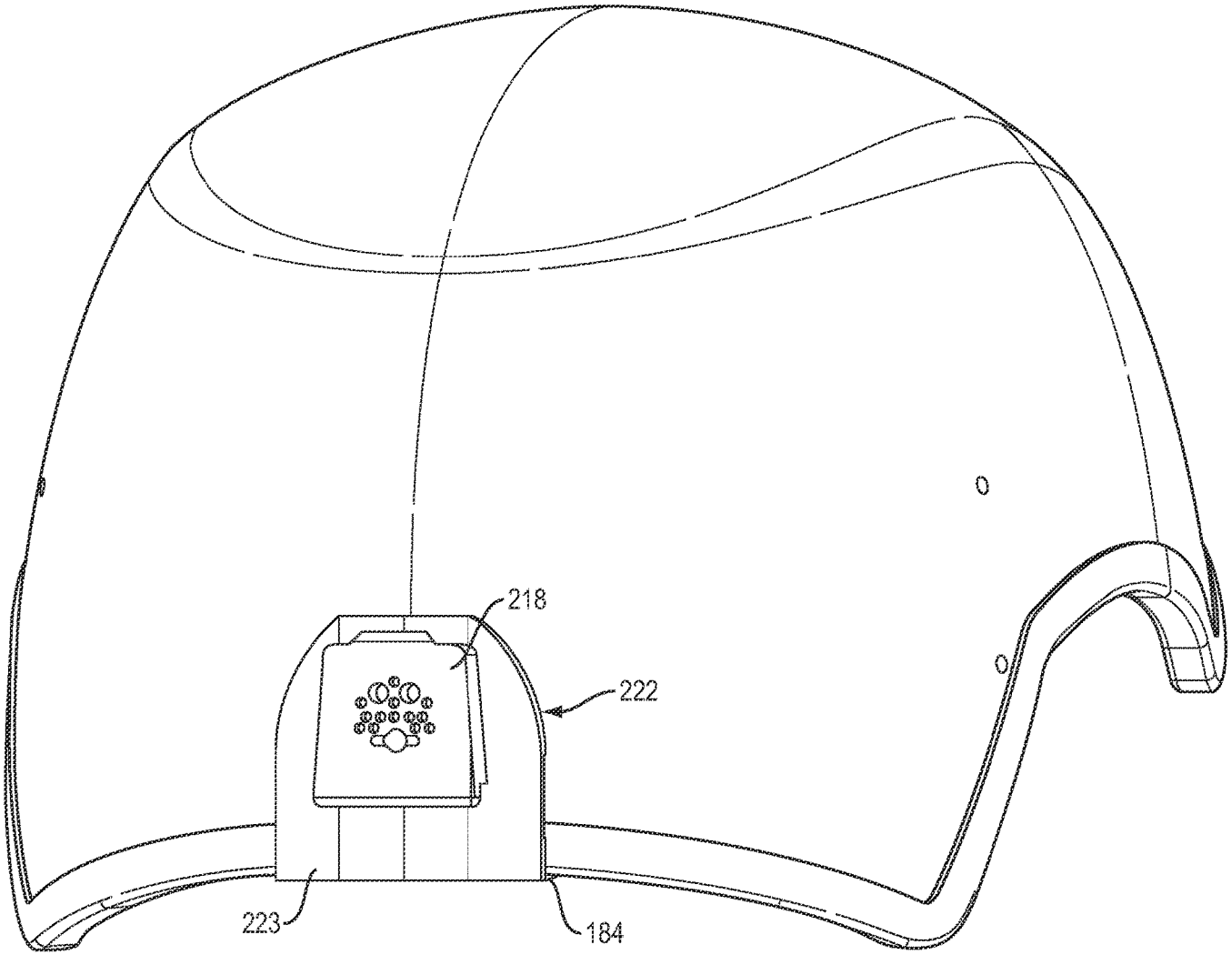
FIG. 27 shows an alternative exemplary hot shoe assembly operable to embody the present development having a hot shoe and secured to the rear brim of the helmet shell with hooks.

Referring now to FIG. 27, there is shown an alternative exemplary hot shoe assembly 222 operable to embody the present development having a hot shoe 218 and secured to the rear brim 114 of the helmet shell 112 with hooks 184. The embodiment of FIG. 27 lacks flex circuits and connector elements emanating therefrom. In the embodiment of FIG. 27, power and/or data connections may be distributed via conductor elements emanating from an attached battery pack or like power/data distribution module.

XII. Side Mount Modules

Figure 28:
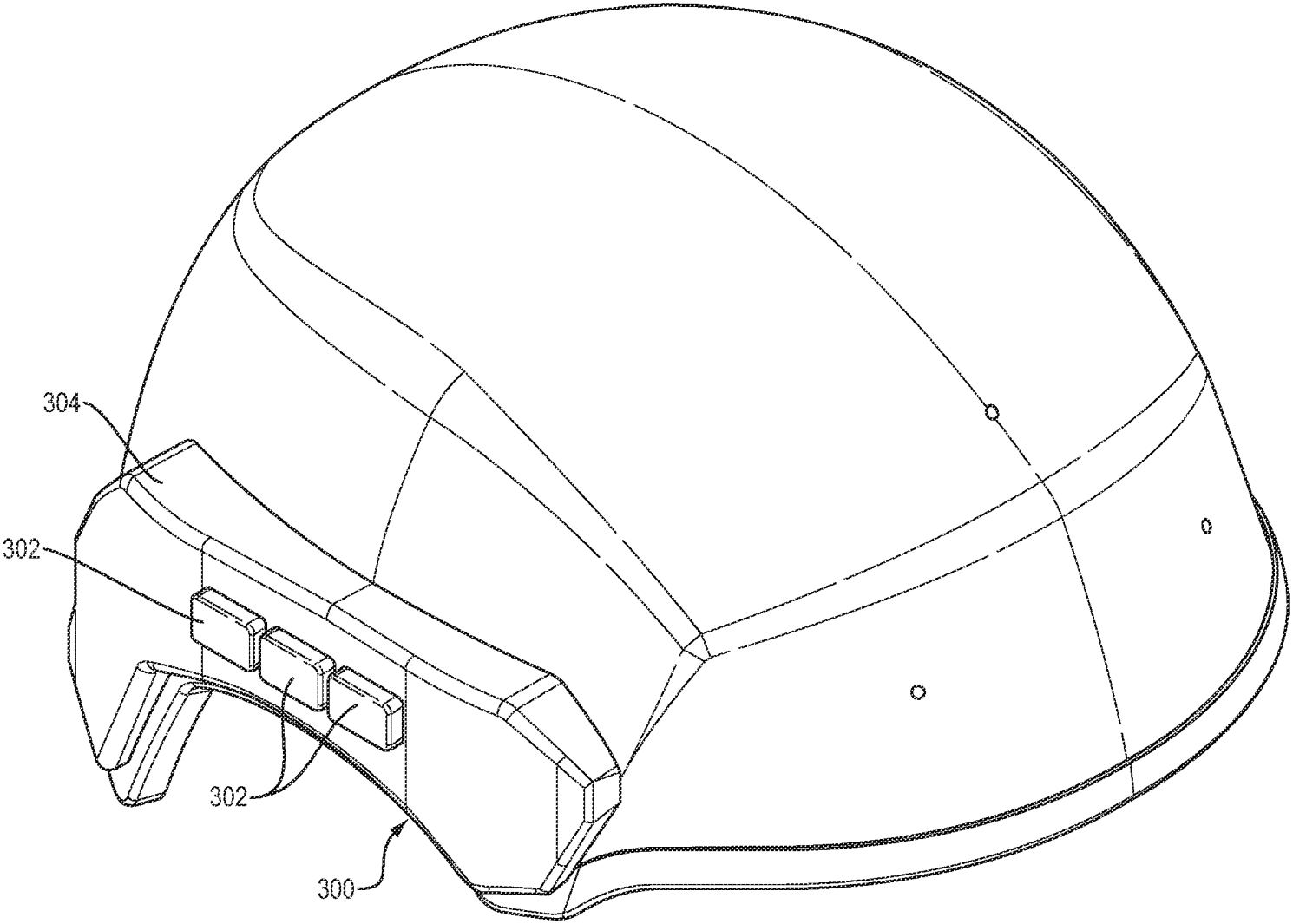
FIG. 28 illustrates an exemplary controller module having a plurality of manually actuatable switches disposed on a housing enclosing circuitry for controlling operation of another accessory device disposed on the helmet.

FIG. 28 illustrates an exemplary controller module 300 having a plurality of manually actuatable switches 302, such as key, buttons, or other switches disposed on a housing 304 enclosing circuitry for controlling operation of another accessory device (not shown) disposed on the helmet. In certain embodiments, the housing 304 includes integral hooks (not shown) for securing the housing to the helmet via tensioning with a cinch mechanism as described above. Alternatively, the housing 304 may be attached with separate hooks in the manner illustrated in FIGS. 11A-11C.

Figure 29:
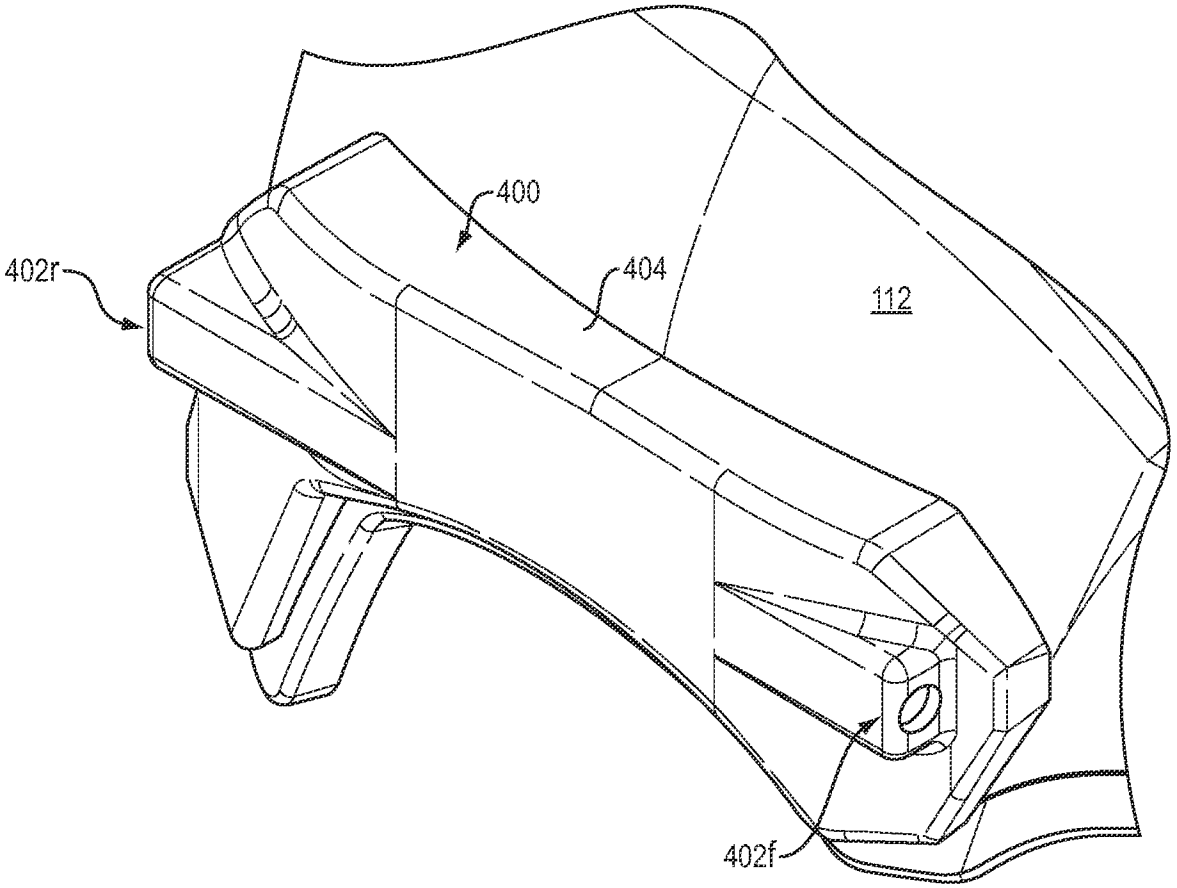
FIG. 29 illustrates an exemplary camera module having one or more cameras mounted within a housing.

FIG. 29 illustrates a camera module 400 having one or more cameras 402 mounted within a housing 404. In the illustrated embodiment, the module 400 has two cameras 402, namely a front-facing camera 402*f* and a rear-facing camera 402*r*. The front camera 402*f* may be a visible camera, a low lux camera for imaging a scene in low light conditions, forward looking infrared (FLIR) or other thermographic camera, short wave infrared (SWIR) camera, or the like. The front facing camera may be utilized to record and/or transmit a scene viewed by the user. The rear camera may be output an imaged scene to a helmet mounted display to increase the situational awareness of the user. In certain embodiments, the housing 404 includes integral hooks (not shown) for securing the housing to the helmet via tensioning with a cinch mechanism as described above. Alternatively, the housing 404 may be attached with separate hooks in the manner illustrated in FIGS. 11A-11C. In certain embodiments, forward and rear camera data is displayed to the eye of the user via a head up display, virtual or augmented reality spectacles or headset, or other near eye display.

Figure 30:
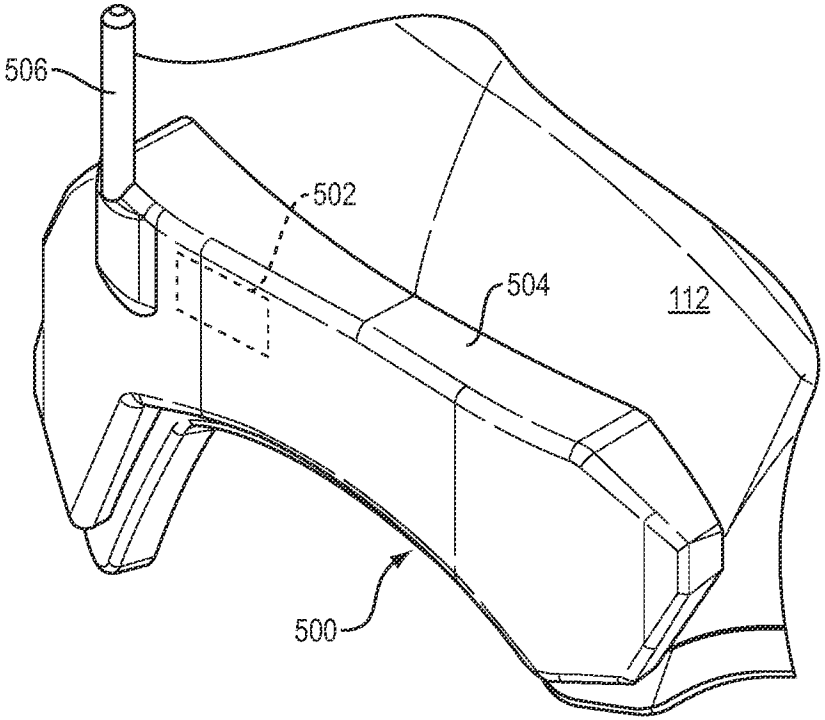
FIG. 30 illustrates an exemplary navigation module having a global positioning system receiver received within a housing.

FIG. 30 illustrates a navigation module 500 having a global positioning system receiver 502 received within a housing 504. A navigation antenna 506 is in electrical communication with the global positioning system receiver 502. The receiver 502 is configured to receive radio frequency positioning signals from the Global Positioning System (GPS) satellite-based radio navigation system or other radio navigation system, such as the GLONASS Navigation Satellite System, or terrestrial-based radio navigation systems. In certain embodiments, the housing 504 includes integral hooks (not shown) for securing the housing to the helmet via tensioning with a cinch mechanism as described above. Alternatively, the housing 504 may be attached with separate hooks in the manner illustrated in FIGS. 11A-11C.

Figure 31:
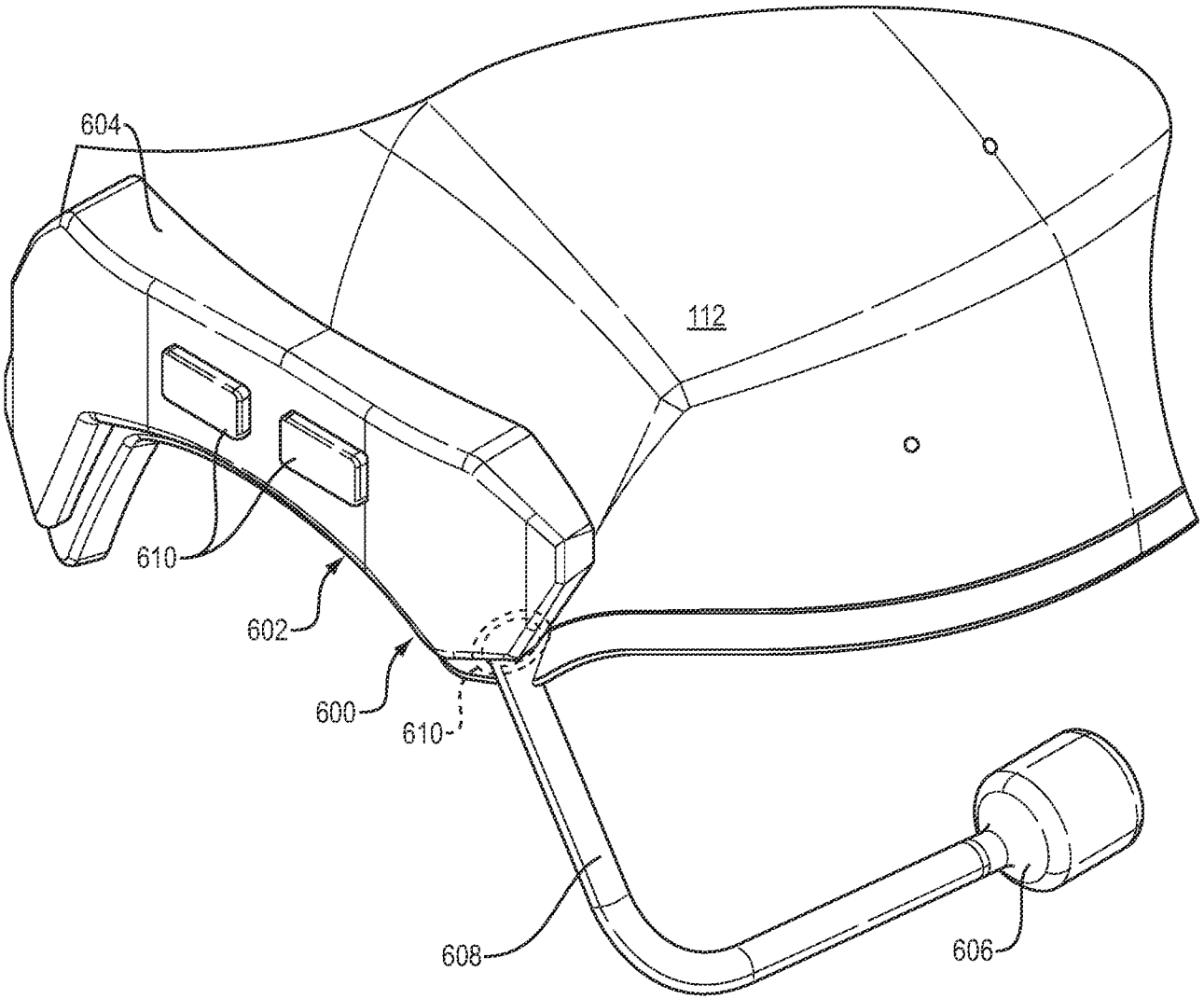
FIG. 31 illustrates an exemplary two-way radio module having a radio frequency (RF) transceiver received within a housing.

FIG. 31 illustrates a two-way radio module 600 having a radio frequency (RF) transceiver 602 received within a housing 604. A microphone 606 is disposed at the end of a microphone boom or arm 608 coupled to the housing 604. The arm 608 may be rotatably coupled, e.g., via a rotatable turret 610, to allow the user to pivot the arm 608 until the microphone 606 is at a desired position in front of the mouth of the user. In certain embodiments, the microphone 606 could be incorporated into the housing 604, such that the boom 608 could include a hollow channel forming an audio wave-guide for transmitting sound waves from the distal end of the boom 608 to a microphone located at the proximal end of the boom.

The unit 600 may also include an audio speaker for receiving an audio signal from the transceiver 602 and outputting an audible signal. Alternately, the unit may include circuitry for transmitting the audio signal from the transceiver to one or more audio speakers disposed within the helmet or other communications system integral or embedded within the helmet 110.

Control buttons 610 are provided for controlling the radio module 600. Exemplary button functions include power on and off, volume up volume down, microphone on and off, and so forth. In certain embodiments, the housing 604 includes integral hooks (not shown) for securing the housing to the helmet via tensioning with a cinch mechanism as described above. Alternatively, the housing 604 may be attached with separate hooks in the manner illustrated in FIGS. 11A-11C.

Figure 32:
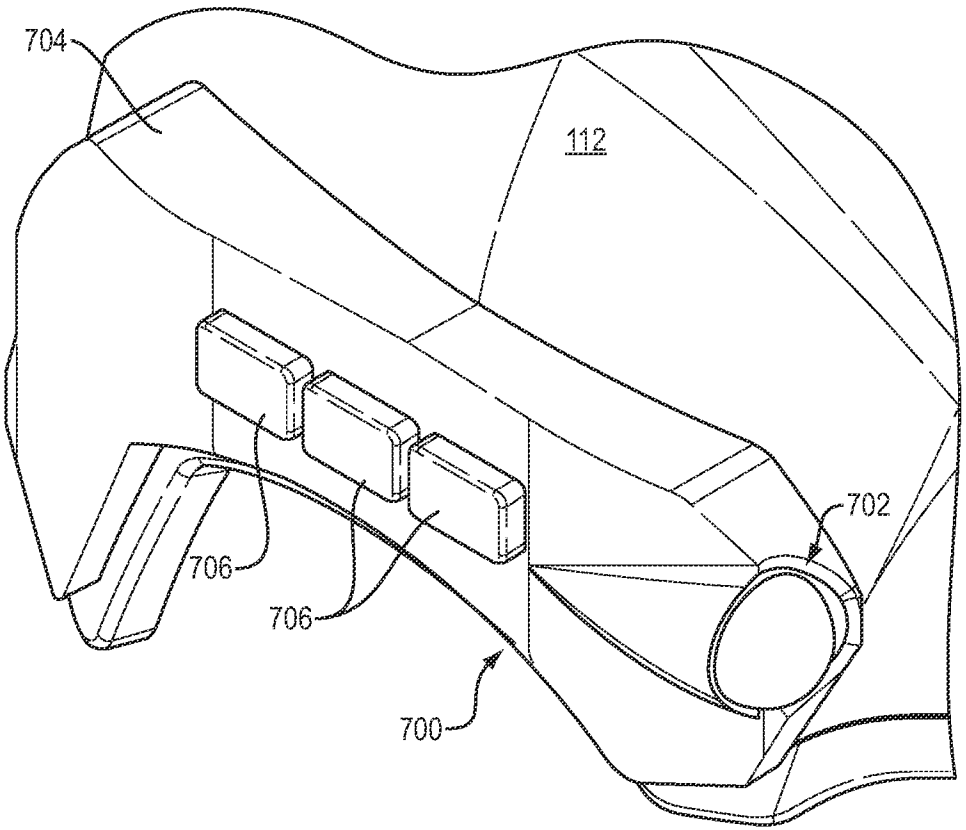
FIG. 32 illustrates an exemplary flashlight module having a light source assembly received within a housing.

Referring now to FIG. 32, there is shown a flashlight module 700 having a light source 702 assembly received within a housing 704. A keypad comprising one or more buttons or switches 706 is provided for controlling operation of the flashlight module 700. In certain embodiments, the light source assembly includes a flashlight head having one or more LED light sources. In certain embodiments a plurality of LEDs are provided, which emit light having the same or different wavelengths. In certain embodiments, the light sources are in the visible rage. In certain embodiments, the lights sources are in the infrared range. In certain embodiments, the light sources include one or more elements in the visible rage and one or more elements in the infrared range, wherein the mode of operation (visible or IR) is selectable using the buttons 706. Other functions controlled by the buttons 706 include on/off, strobe, and so forth. In certain embodiments, the housing 704 includes integral hooks (not shown) for securing the housing to the helmet via tensioning with a cinch mechanism as described above. Alternatively, the housing 704 may be attached with separate hooks in the manner illustrated in FIGS. 11A-11C.

Figure 33:
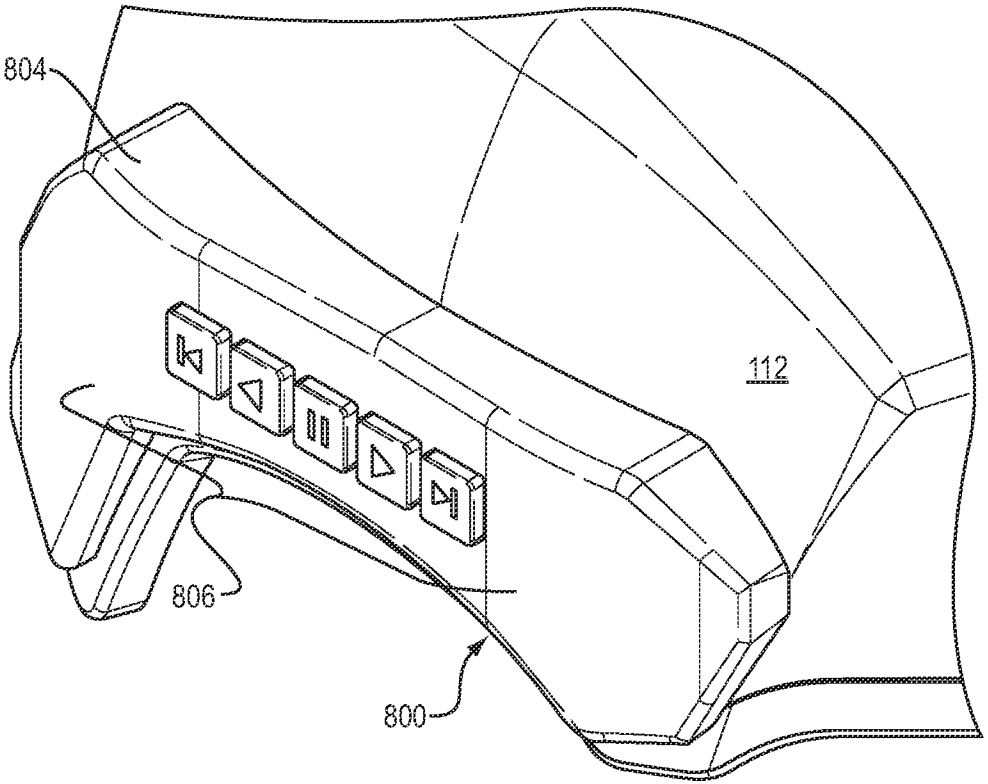
FIG. 33 illustrates an exemplary music player module.

Referring now to FIG. 33, there is shown a music player module 800 including a housing 804. In certain embodiments, the music player module includes a digital storage medium storing digital representations of music/audio files, which may be in MP3 format or other audio format. Alternately, the music player 800 may be configured to control operation of a paired or associated music player or other device such as a smartphone having music playback capability. A keypad or button array provides comprising one or more buttons or switches 806 is provided for controlling playback operation, such as "Play," "Pause," "Stop," "Play/Pause Toggle," "Reverse," "Rewind," "Fast Forward," "Skip Forward," "Skip Forward," and so forth. In certain embodiments, music playback is through audio speakers within the helmet 110, such as speakers associated with a helmet mounted communication system. In certain embodiments, the housing 804 includes integral hooks (not shown) for securing the housing to the helmet via tensioning with a cinch mechanism as described above. Alternatively, the housing 804 may be attached with separate hooks in the manner illustrated in FIGS. 11A-11C.

Figure 34:
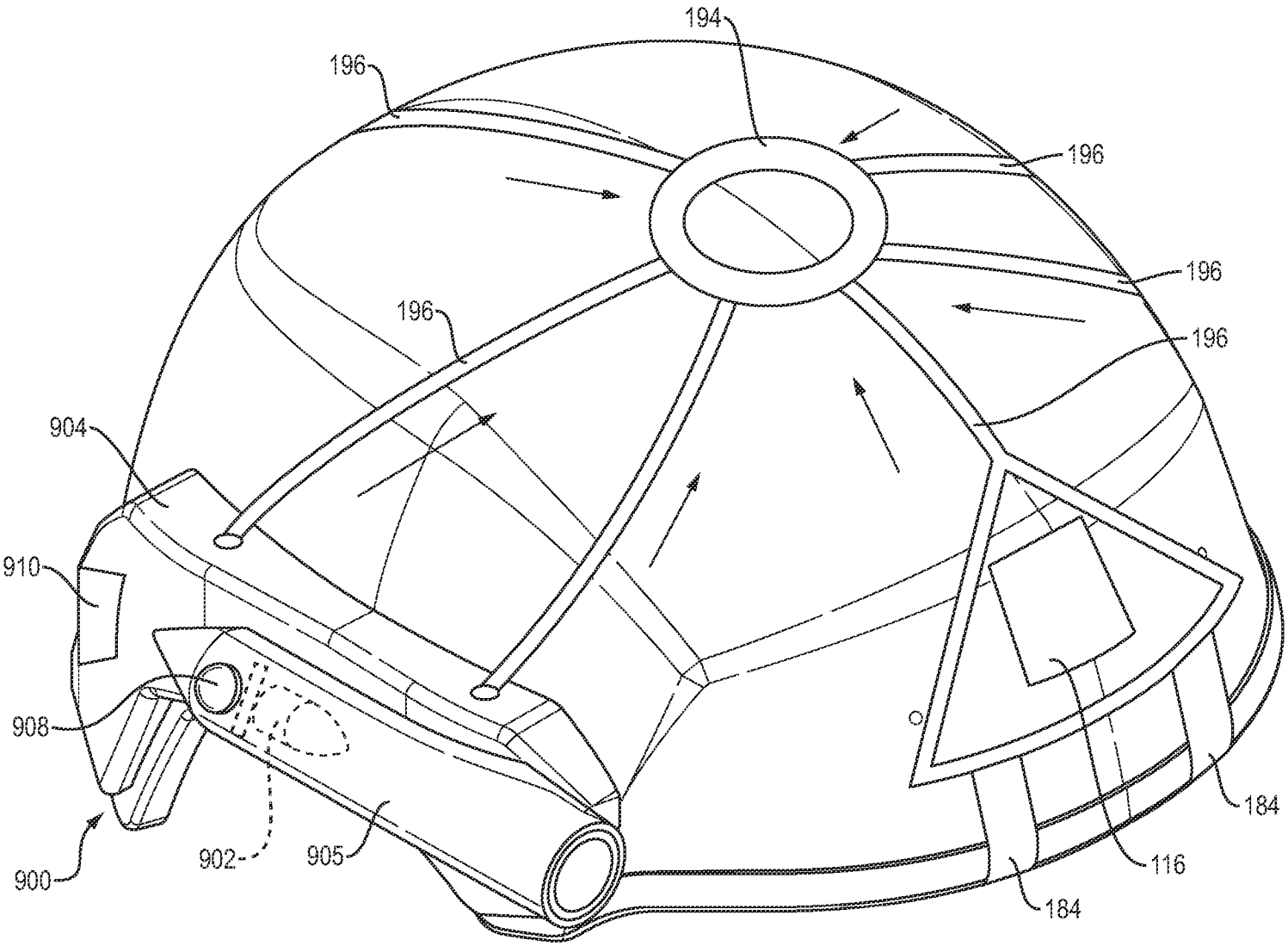
FIG. 34 illustrates an exemplary helmet mounted gun or weapon module.

FIG. 34 illustrates an exemplary helmet mounted gun or weapon module 900 having a housing 904 defining a barrel 905, the module 900 including a firing mechanism for firing a projectile 902, e.g., a small projectile such as a .22 caliber cartridge 906. A fire button 908 and a safety 910 are disposed on the housing. The fire button 908 interacts with the firing mechanism, e.g., mechanically or electronically, to cause a firing of the projectile when pressed. The safety mechanism 910 is movable between a locked position and a released position, and interacts with the firing mechanism to prevent firing of the projectile when the safety 910 is in the locked position and to permit firing of the projectile when the safety is in the released position. In certain embodiments, the housing 904 includes integral hooks (not shown) for securing the housing to the helmet via tensioning with a cinch mechanism as described above. Alternatively, the housing 904 may be attached with separate hooks in the manner illustrated in FIGS. 11A-11C.

Figure 35:
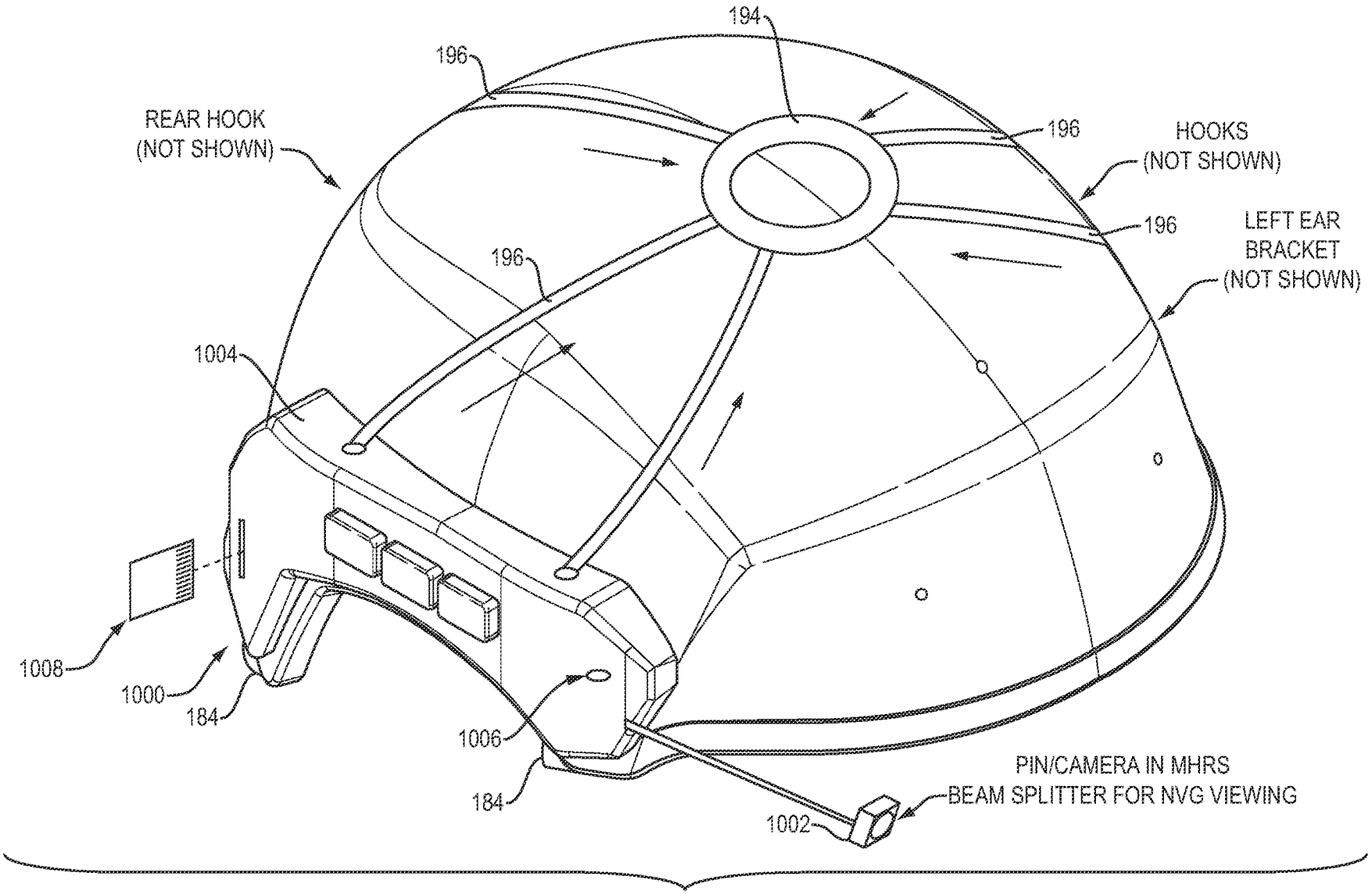
FIG. 35 illustrates an exemplary mission helmet recording system (MHRS).

FIG. 35 illustrates an exemplary mission helmet recording system (MHRS) 1000 for recording an imaged scene. A camera 1002 is disposed within a housing 1004. In certain embodiments, a beam splitter is provided wherein a portion of the light from a scene being images is passed to the camera 1002 and a portion is passed to an associated night vision device. An audio microphone 1006 is provided to record associated audio of the mission or scene being recorded. A keypad comprising one or more buttons or switches 1006 is provided for controlling operation of the recording module 1000. Digital representations of recorded audio and video may be stored on an associated electronic storage media such as a flash storage card 1008. In the illustrated embodiment, the housing 1004 may be attached with hooks 184, which may be attached to cinching cables 196 as illustrated in FIGS. 11A-11C, which pass through openings 1010 in the housing 1004. In alternative embodiments, the housing 1004 includes integrally formed hooks for securing the housing to the helmet via tensioning with a cinch mechanism as described above.

Figure 36:
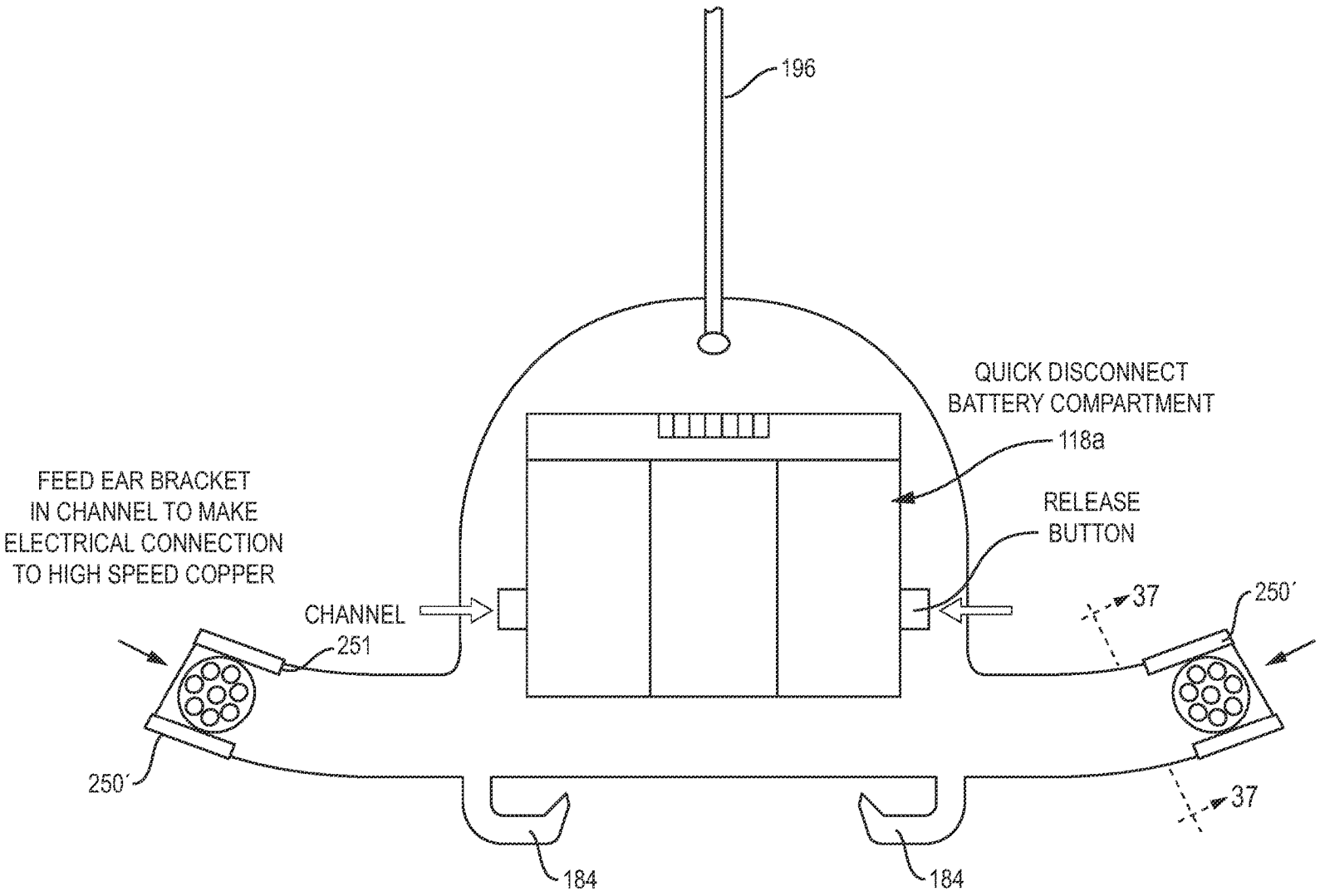
FIG. 36 illustrates an exemplary quick connect/disconnect electrical connector.
Figure 37:
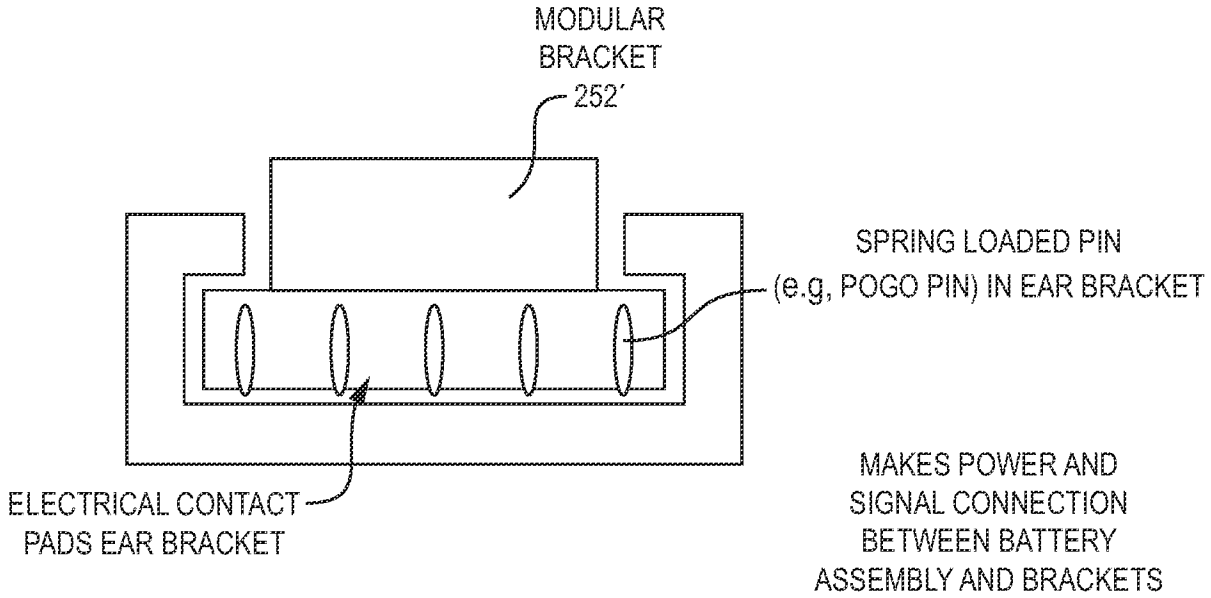
FIG. 37 is a side view of the quick connect/disconnect electrical connector coupled to a mating connector.

FIG. 36 illustrates an exemplary hot shoe assembly having quick connect/disconnect electrical connectors 250'. The connectors 250' each have a channel 251 for feeding the connector 252' from the ear bracket to make an electrical connection to a high-speed copper (e.g., a twisted conductor pair) connection. FIG. 37 is a side view of the connector 250' coupled to a mating connector 252'.

Figure 38:
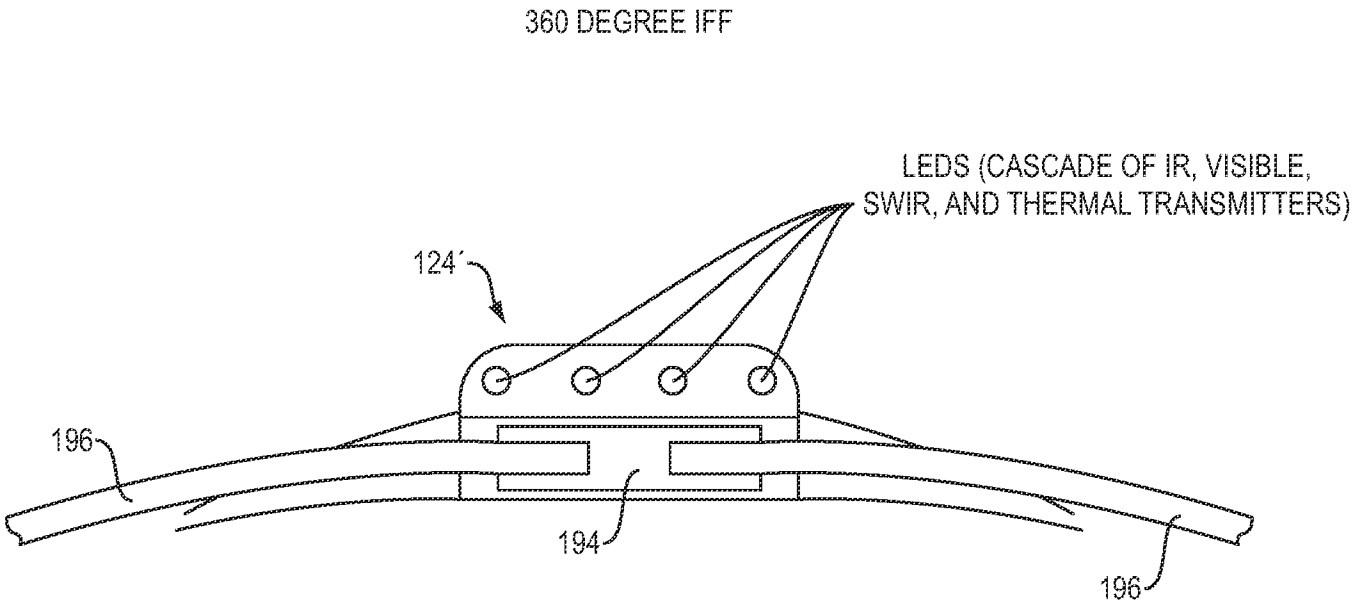
FIG. 38 is an enlarged view of an exemplary IFF module with integral spool mechanism.

FIG. 38 is an enlarged view of an exemplary IFF module 124' with integral spool mechanism.

Other accessory devices contemplated include a heater control, head up display attachment, laser training kit, physiological monitor, and an shot or other acoustic sound location module, e.g., employing a microphone array.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof.

What is claimed is:

1. A helmet mounting system for removably attaching an accessory device to the helmet, comprising:

a helmet including a shell configured to fit over a user's head and a brim disposed about a periphery of the shell;

one or more cables attached to a hook, the hook configured to removably engage the brim;

each of said one or more cables having at least one end attached to a spool, the spool being rotatable in a first direction to cause a winding of the one or more cables around the spool and in a second direction opposite the first direction to cause an unwinding of the cable around the spool; and a tensioning mechanism attached to the helmet and coupled to the spool, wherein rotation of the spool in the first direction is configured to increase tension in the cable for securing the accessory device to the helmet and rotation of the spool in the second direction is configured to decrease tension in the cable for releasing the accessory device from the helmet.

2. The helmet mounting system of claim 1, further comprising:

a knob coupled to the spool wherein the spool is configured to rotate responsive to rotation of the knob;

a ratchet mechanism coupled to the spool and configured to permit rotation of the spool in the first direction and prevent rotation of the spool in the second direction; and a release mechanism configured to selectively disengage the ratchet mechanism from the spool to permit rotation of the spool in the second direction.

3. The helmet mounting system of claim 1, further comprising:

a shroud disposed at a front and central portion of the shell;

a power and data management module disposed at a rear and central portion of the shell, the power and data management module including one or more batteries for supplying one or more of electrical power, data signals and control signals to one or more helmet mounted accessory components.

4. The helmet mounting system of claim 3, further comprising one or both of:

one or more accessory rail interface members; and an identification friend or foe (IFF) apparatus.

5. The helmet mounting system of claim 3, further comprising said one or more accessory rail interface members and one or more accessory devices removably attachable to said one or more accessory rail interface members, wherein the one or more accessory rail interface members are selected from the group consisting of:

a controller module having a plurality of manually operable controller switches disposed on a controller housing enclosing circuitry for controlling operation of another accessory device disposed on the helmet;

a camera module having one or more cameras mounted within a camera housing;

a navigation module having a global positioning system receiver received within a navigation housing, the global positioning system receiver configured to receive radio frequency positioning signals from a satellite-based radio navigation system;

a radio module having a radio frequency transceiver received within a radio housing, microphone operably coupled to the radio frequency transceiver, an audio speaker operably coupled to the radio frequency transceiver, and one or more manually operable radio control buttons disposed on the radio housing for controlling operation of the radio module;

a flashlight module having a light source assembly received within a flashlight housing and one or more manually operable flashlight switches for controlling operation of the flashlight module;

a music player module including a music player housing and one or more manually actuatable music player switches for controlling music playback operation;

a weapon module for firing a projectile, the weapon module including a firing mechanism received within a weapon housing, a manually actuatable fire button on the weapon housing and interacting with the firing mechanism, and a barrel for directing a path of the projectile;

a mission recording system for recording a scene viewed with a night vision device. Digital representations of recorded audio and video may be stored on an associated electronic storage media such as a flash storage card.

6. The helmet mounting system of claim 3, further comprising:

a first electrical cable extending along a centerline of the shell between the power and data management module and an identification friend or foe apparatus disposed on the shell;

a second electrical cable extending between the power and data management module and at least one accessory rail interface member disposed on a first transverse side of the shell;

a third electrical cable extending between the power and data management module and at least one accessory rail interface member disposed on a second transverse sides of the shell;

a fourth electrical cable extending between the at least one accessory rail interface member on the first transverse side of the shell to the shroud; and a fifth electrical cable extending between the at least one accessory rail interface member on the second transverse side of the shell to the shroud.

7. The helmet mounting system of claim 3, further comprising:

a first electrical cable extending along a centerline of the shell between the power and data management module and an identification friend or foe apparatus disposed on the shell;

a second electrical cable in electrical communication with the first electrical cable extending along a centerline of the shell between the identification friend or foe module and the shroud module.

8. The helmet mounting system of claim 7, further comprising:

a third electrical cable extending between the power and data management module and a first accessory rail interface member;

a fourth electrical cable extending between the power and data management module and a second accessory rail interface member, wherein the first and second accessory rail interface members are disposed on opposite lateral sides of the shell;

an optional fifth electrical cable extending between the first accessory rail interface member and a third accessory rail interface member; and an optional sixth electrical cable extending between the second accessory rail interface member and a fourth accessory rail interface member, wherein the third and fourth accessory rail interface members are disposed on opposite transverse sides of the shell.

9. The helmet mounting system of claim 8, further comprising:

a first housing member receiving the shroud;

a second housing member receiving the power and data management module a third housing member receiving the first accessory rail interface member;

a fourth housing member receiving the second accessory rail interface member;

a fifth housing member receiving the IFF apparatus;

a rear cable enclosure extending between the second and fifth housing members and receiving at least a portion of the first third and fourth electrical cables;

a front cable enclosure extending between the first and fifth housing members and receiving the second electrical cable;

a first side cable enclosure extending between the third and fifth housing members and receiving at least a portion of the third electrical cable; and a second side cable enclosure extending between the fourth and fifth housing members and receiving at least a portion of the fourth electrical cable.

10. The helmet mounting system of claim 9, further comprising:

a dial which is manually rotatable to cause rotation of the spool in the first direction;

wherein said one or more cables includes a first cable having a first end coupled to the spool and a second end coupled to the spool, the first cable passing through a series of cable guides in each of the first side cable enclosure, front cable enclosure, and second side cable enclosure, wherein rotation of the spool in the first direction causes a portion of the cord to be taken up on the spool.

11. The helmet mounting system of claim 10, wherein the fifth housing includes four radially extending arms, each of which slidably engages a respective one of the rear cable enclosure, front cable enclosure, first side cable enclosure, and second side cable enclosure.

12. The helmet mounting system of claim 3, further comprising:

an electrical circuit member in electrical communication with the power and data management module and an accessory device, the electrical circuit member selected from the group consisting of an electrical cable, a printed circuit board, and a flexible circuit comprising a one or more conductive elements on a flexible circuit substrate.

13. The helmet mounting system of claim 1, further comprising an accessory device having a housing, wherein said hook is attached to said housing.

14. The helmet mounting system of claim 1, further comprising an accessory device having a housing, wherein said tightening mechanism is attached to said housing.

15. The helmet mounting system of claim 14, wherein said hook is selected from the group consisting of:

a hook integrally formed with the housing;

a hook removably attached to the housing; and a hook having a plurality of clearance openings for adjusting a height of the hook with respect to the housing.

16. The helmet mounting system of claim 15, wherein at least one of the one or more cables passes through an interior of said housing.

17. The helmet mounting system of claim 15, wherein at least one of the one or more cables attaches to a first side of said housing and said hook is disposed on a second side of said housing spaced apart from the first side of said housing.

18. The helmet mounting system of claim 1, wherein at least one of said one or more cables comprises an electrical cable which is electrically coupled to said accessory device.

19. The helmet mounting system of claim 1, wherein at least one of the one or more cables has a ball attached to an end thereof, the ball received through an elongate slot having an enlarged diameter end sized to receive the ball therethrough and a narrow end sized to receive the cable while preventing the ball from passing therethrough when tension is applied to the cable.

20. The helmet mounting system of claim 1, further comprising:

a hot shoe assembly disposed at a rear and central portion of the shell, the hot shoe assembly including a hot shoe disposed on a hot shoe substrate; and optionally, one or more flexible circuit substrates extending from the hot shoe substrate.

* * * * *